US009321234B2

(12) United States Patent
Cheich et al.

(10) Patent No.: US 9,321,234 B2
(45) **Date of Patent: *Apr. 26, 2016**

(54) AUTOMATED DUNNAGE FILLING SYSTEM AND METHOD

(75) Inventors: Robert C. Cheich, Independence, OH (US); David V. Murphy, Painesville Township, OH (US); Harry H. Lu, Mentor, OH (US); Kevin W. Park, Chardon, OH (US); Thomas A. Bilkie, Jr., Medina, OH (US)

(73) Assignee: Ranpak Corp., Concord Township, OH (US)

( * ) Notice: Subject to any disclaimer, the term of this patent is extended or adjusted under 35 U.S.C. 154(b) by 1306 days.

This patent is subject to a terminal disclaimer.

(21) Appl. No.: 12/851,978

(22) Filed: Aug. 6, 2010

(65) Prior Publication Data

US 2010/0293898 A1 Nov. 25, 2010

Related U.S. Application Data

(63) Continuation of application No. 11/718,723, filed as application No. PCT/US2005/040458 on Nov. 7, 2005, now Pat. No. 7,788,884.

(60) Provisional application No. 60/664,543, filed on Mar. 23, 2005, provisional application No. 60/625,356, filed on Nov. 5, 2004.

(51) Int. Cl.
*B65B 55/20* (2006.01)
*B31D 5/00* (2006.01)

(52) U.S. Cl.
CPC ..... *B31D 5/0047* (2013.01); *B65B 55/20* (2013.01); *B31D 2205/007* (2013.01); *B31D 2205/0035* (2013.01); *B31D 2205/0082* (2013.01); *Y10S 493/967* (2013.01)

(58) Field of Classification Search
USPC ..... 53/472, 238, 376.8, 458, 491, 467, 484, 53/376.3, 372.6
See application file for complete search history.

(56) References Cited

U.S. PATENT DOCUMENTS

| | | | | |
|---|---|---|---|---|
| 2,714,792 | A * | 8/1955 | Wright et al. | 53/526 |
| 3,080,033 | A | 3/1963 | Graeme et al. | |
| 3,650,877 | A | 3/1972 | Johnson | |
| 3,667,593 | A | 6/1972 | Pendleton | |
| 3,981,123 | A | 9/1976 | Flanagan | |
| 4,524,560 | A | 6/1985 | Goodman | |
| 4,565,050 | A | 1/1986 | Norris | |
| 4,674,268 | A * | 6/1987 | Gavronsky et al. | 53/468 |
| 4,713,928 | A * | 12/1987 | Tisma | 53/526 |
| 4,800,708 | A | 1/1989 | Sperry | |

(Continued)

*Primary Examiner* — Nathaniel Chukwurah
(74) *Attorney, Agent, or Firm* — Renner, Otto, Boisselle & Sklar, LLP

(57) ABSTRACT

A system (10) for automatically dispensing a strip of dunnage to a container (14) includes a dispenser (12) having an outlet (92) from which the dispenser can feed a length of a strip of dunnage lengthwise, a container support (36) for supporting a container (14) thereon, and a pusher device (114) at the outlet (92) for pushing, more particularly propelling, a trailing end of the strip of dunnage from the outlet (92) toward the container support (36). The outlet (92) is aligned with the container support (36). Thus the outlet (92) is positioned relative to a container (14) such that the strip will curl or fold back and forth upon itself within the confines of the container (14) as it is being fed from the outlet (92). A container closer (120, 130 and 32) automatically closes the flaps (80 and 82) of the container (14).

5 Claims, 16 Drawing Sheets

(56) References Cited

U.S. PATENT DOCUMENTS

| | | | | |
|---|---|---|---|---|
| 4,922,687 | A | 5/1990 | Chow et al. | |
| 5,387,173 | A | 2/1995 | Simmons, Jr. | |
| 5,511,362 | A | 4/1996 | Morita et al. | |
| 5,647,910 | A * | 7/1997 | Brown | 118/710 |
| 6,070,396 | A | 6/2000 | Rinaldi et al. | |
| 6,179,765 | B1 | 1/2001 | Toth | |
| 6,183,586 | B1 | 2/2001 | Heidelberger | |
| 6,226,965 | B1 | 5/2001 | Lam | |
| 6,416,451 | B1 | 7/2002 | Ratzel et al. | |
| 6,910,997 | B1 | 6/2005 | Yampolsky et al. | |
| 7,186,208 | B2 | 3/2007 | Demers et al. | |
| 7,216,468 | B2 | 5/2007 | Goodman | |
| 7,788,884 | B2 * | 9/2010 | Cheich et al. | 53/472 |

* cited by examiner

AUTOMATED DUNNAGE FILLING SYSTEM AND METHOD

This application is a continuation of U.S. patent application Ser. No. 11/718,723, filed May 7, 2007, which is a national phase of International Patent Application No. PCT/US2005/040458, filed Nov. 7, 2005, published in English as Publication No. WO 2006/052980 A2, which claims the benefit of U.S. Provisional Application No. 60/664,543, filed Mar. 23, 2005, and U.S. Provisional Application No. 60/625,356, filed Nov. 5, 2004, which are hereby incorporated herein by reference.

FIELD OF THE INVENTION

This invention relates generally to a dunnage dispensing system for supplying dunnage to a container, and more particularly to an automated system for dispensing a strip of dunnage into a container.

BACKGROUND

In the process of shipping one or more articles in a container, a packer typically places some type of dunnage material in the shipping container along with the articles. The dunnage material partially or completely fills the empty space the void volumes around the articles in the container. The dunnage material prevents or minimizes any shifting of the articles in the container and/or cushions the articles in the container during the shipping process. Some commonly used dunnage materials are plastic foam peanuts, plastic bubble pack, air bags and converted paper dunnage.

An exemplary dunnage conversion machine that converts a continuous sheet of paper into a crumpled strip of dunnage is disclosed in U.S. Pat. No. 6,676,589. Typically, as the crumpled strip is being discharged from the conversion machine a person, commonly referred to as a packer, guides, pushes and/or folds the crumpled strip into the container. The rapid speed at which the conversion machine can produce dunnage can make the packer's task difficult as well as tedious. Nevertheless, a packer heretofore generally has been needed to ensure that the dunnage properly fills the void around the articles in the container, and further to close and seal the container or at least initiate closure of the container prior to being passed to a case sealer.

SUMMARY

The present invention provides an automatic system and method for inserting dunnage, particularly a continuous strip of dunnage, into a container, thereby avoiding or minimizing the need for a packer, and freeing the packer for other tasks.

According to one aspect of the invention, a method of automatically dispensing a strip of dunnage into a container comprises the steps of using a dispenser to feed a length of a strip of dunnage lengthwise from an outlet of the dispenser, positioning the outlet relative to a container such that the strip will curl or fold back and forth upon itself within the confines of the container as it is being fed from the outlet of the dispenser, and using a container closer to move a cover or flaps of the container to a position that closes the container.

According to another aspect of the invention, a system for automatically dispensing a strip of dunnage into a container comprises a dispenser having an outlet from which the dispenser can feed a length of a strip of dunnage lengthwise, a container support for supporting a container thereon, the outlet being aligned with the container support, and a pusher device at the outlet for pushing, more particularly propelling, a trailing end of the strip of dunnage from the outlet toward the container support.

In accordance with another aspect of the invention, a system for automatically dispensing dunnage into a container comprises a chamber having an outlet opening at one end thereof, a dispenser for feeding dunnage into the chamber to form an accumulated quantity of dunnage, and a plunger for pushing the accumulated quantity of dunnage through the outlet of the chamber, whereby the dunnage can be dispensed into a container supported at the outlet of the chamber.

According to still another aspect of the invention, a system for automatically dispensing dunnage into a container comprises a dispenser having an outlet from which dunnage can be supplied and a container closer adjacent the outlet, the container closer having a movable member for effecting at least partial enclosure of an open side of a container.

According to another aspect of the invention, a method of automatically dispensing dunnage into a container comprises the steps of moving one or more flaps of a container inwardly relative to an open side of the container to partially close the open side of the container, and using a dispenser to feed dunnage into the partially closed container from an outlet of the dispenser that is aligned with the open side of the container.

According to another aspect of the invention, a system for automatically dispensing a strip of dunnage into a container comprises a container support for supporting a container at a dunnage filling station, a dispenser having an outlet from which the dispenser can feed a strip of dunnage into a container supported on the container support, and a container closer at the dunnage filling station having one or more movable members for pushing at least one flap of a container from an upright orientation toward a substantially horizontal orientation to at least partially close the container.

In accordance with another aspect of the invention, a system for automatically dispensing a strip of dunnage into a container comprises a container support for supporting a container and a dunnage dispenser having an outlet aligned with the support and from which the dispenser can dispense a strip of dunnage toward the support, wherein the container support and the outlet are movable relative to one another in at least a vertical direction and at least one of two orthogonal directions transverse the vertical direction to dispense dunnage into desired portions of the container.

According to yet another aspect of the invention, a method of automatically dispensing a strip of dunnage into a container, comprising the steps of using a dispenser to feed a strip of dunnage from an outlet of the dispenser, and using at least one positioning device to move one or more of the outlet and a container relative to the other of the outlet and the container while feeding a strip of dunnage from the outlet into the container.

According to another aspect of the invention, a system for automatically dispensing a strip of dunnage into a container comprises a dispenser having an outlet from which the dispenser can feed a strip of dunnage, a container support for supporting a container at a dunnage filling station adjacent the outlet with an open side of the container aligned with the outlet, a container closer at the dispensing station for at least partially closing the container, and a container closing station at a location removed from the dunnage filling station for closing and securing the container in a closed condition, and a controller for instructing the dispenser to dispense a strip of dunnage through the outlet and then instructing the container support to transport the container from the dunnage filling station to the container closing station.

Yet another aspect of the invention provides a method of automatically dispensing a strip of dunnage into a container, comprising the steps of using a dispenser to feed a predetermined length of a strip of dunnage through an outlet of the dispenser into a container at a dunnage filling station; using a container support to support a container at the dunnage filling station with an open side of the container aligned with the outlet of the dispenser; and using a container closer to move a cover or flaps of the container to a position that closes the container.

In accordance with another aspect of the invention, a packing system for supplying dunnage to a container comprises a source of dunnage and a dispensing assembly downstream of the source of dunnage that includes an elongated accumulating chamber and an outlet feed device at a downstream end of the elongated accumulating chamber that inhibits yet allows passage of the dunnage therethrough so that the dunnage can enter the chamber at an upstream end at a first rate and exit the chamber at a downstream end at a second rate that is less than the first rate.

According to another aspect of the invention, a method for supplying dunnage to a container to fill a void in the container around at least one article being packed comprises the following steps: supplying a length of dunnage; causing the dunnage to undulate transverse to its length within an accumulating chamber; and actuating a pusher to push the dunnage into a container.

According to still another aspect of the invention, a packing system for supplying dunnage to a container comprises a source of dunnage, and a dispensing assembly downstream of the source of dunnage that includes an elongated accumulating chamber and a rotating member at a downstream end of the chamber that feeds dunnage out of the chamber.

The foregoing and other features of the invention are hereinafter fully described and particularly pointed out in the claims, the following description and the annexed drawings setting forth in detail several illustrative embodiments of the invention, such being indicative, however, of but a few of the various ways in which the principles of the invention may be employed.

DETAILED DESCRIPTION

Figure 1:
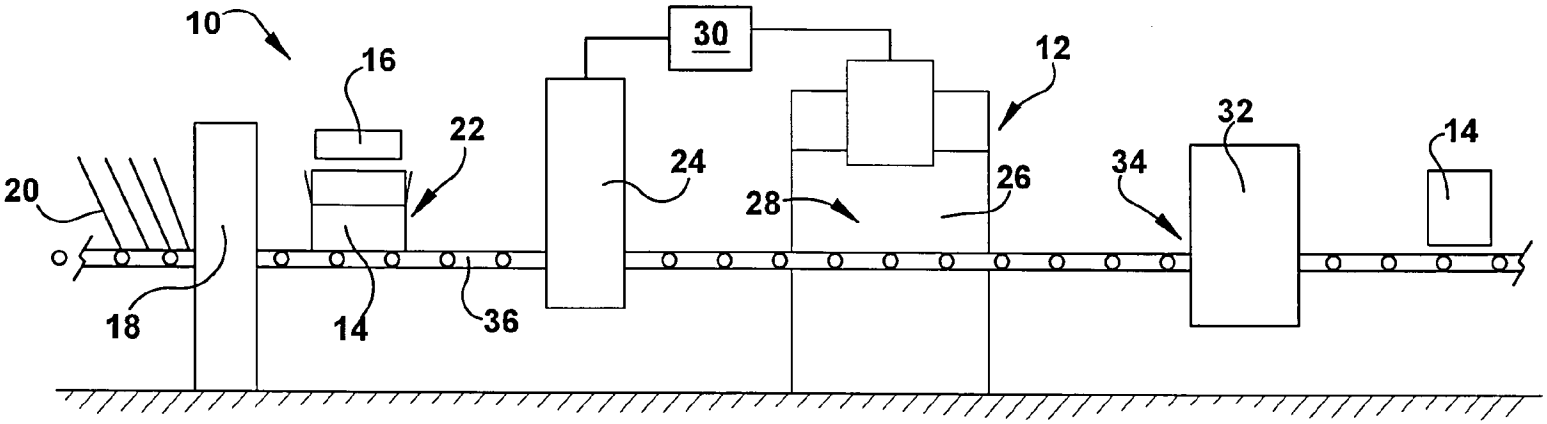
FIG. 1 is a schematic elevational view of a packing line including an automated dunnage filling system according to the present invention.

Referring now to the drawings in detail, and initially to FIG. 1, an exemplary packing system 10 includes an automatic dunnage filling system 12 in accordance with the present invention. The dunnage filling system 12 automatically dispenses dunnage into a container to partially or completely fill a void volume in a container around one or more articles placed therein for shipping. "Filling" a void with dunnage thus includes providing dunnage to partially occupy the void as well as completely occupying the void. As a result, a dunnage filling system also can be referred to as a dunnage dispensing system to avoid any confusion about the degree of fill provided by the dispensed dunnage.

As will be appreciated, the packing system and components thereof may be used to pack many different types of containers, although in most instances the container will be a box, also referred to as a carton. Consequently, the terms box, container and carton are for the most part herein used interchangeably. However, adaptations may need to be made for different types of containers. For example, some containers may be provided pre-erected or do not require erection, thereby negating the need for the hereinafter described box erector. These adaptations and other modifications needed to accommodate containers of various types will be evident to those of ordinary skill in the art.

Moving from left to right in FIG. 1, the illustrated automated packing system 10 includes a box erector 18, a product loading station 22, a void measuring device 24, a dunnage filling station 28 and a container closure station 34. The box erector 18 erects a box from a flat blank 20. At the product loading station 22 one or more articles or objects 16 are loaded into the box for shipping. The void measuring device 24, which includes one or more sensors, determines the size of the box 14 and/or the volume of the void in the box 14 around the one or more objects 16 loaded therein. At the dunnage filling station 28, the dunnage filling system 12 fills the void with dunnage and also may partially close the box 14. At the container closure station 34, a box sealer 32 completes the closure of the box and seals the container in its closed condition, ready to ship.

The packing system 10 also includes a controller 30 for controlling the packing system 10. The controller 30 can be composed of one or more processors and associated peripheral devices for controlling the various components of the system and the transport of the container through the system. Individual components may have their own controllers which may be viewed as forming part of the overall system controller. An exemplary controller is a programmable logic controller (PLC). In addition, the system includes a container support and/or transport assembly, such as the illustrated conveyor 36 which may have portions thereof powered for transport of the container from one station to the next under the control of the controller as further discussed below.

In conjunction with signals from the void measuring device 24, the controller determines the container height, which it then uses to control the conveyor 36 or other container support and/or the dunnage dispenser to position the dispenser outlet in proximity to an open side of the container. The controller also can determine the void volume in the container based on signals from the void measuring device. The controller can then control the dunnage dispenser to dispense a quantity of dunnage to fill the void. A larger void volume might require a longer length of dunnage, for example.

Therefore, in accordance with an automated packing process according to the invention, a container 14 is erected by the box erector 18 and moved to the product loading station 22 where one or more articles 16 are placed in the container 14. The container 14 is then moved to the dunnage filling station 28 where dunnage is automatically dispensed into the container to fill the void in the container. The container is then passed through the box sealer 32 where the container 14 is closed and sealed for shipping. All of these steps can be performed automatically. However, the present invention focuses on automatic performance of the dunnage filling and container closing operations, thereby negating the need for a packer who in the past was needed to perform these operations albeit with the aid of automated equipment.

The packing system 10 also includes a container support for supporting a container for the dunnage filling system 12 to fill the void therein with dunnage. The container support can include a table, a stand, a conveyor or other surface that can support the container 14 for receipt of the dunnage strip. The container support can include a transport device for transporting a container through one or more stations in the packing system 10. The conveyor 36 is controllably started and stopped to move the container 14 through the packing system 10, and can include one continuous conveyor or a plurality of conveyor segments. In the illustrated embodiment, the container support is in the form of a conveyor 36. The conveyor 36 or other container support can include a positioning device to register or otherwise position the container 14 relative to and aligned with an outlet of the dunnage dispenser 26.

Figure 2:
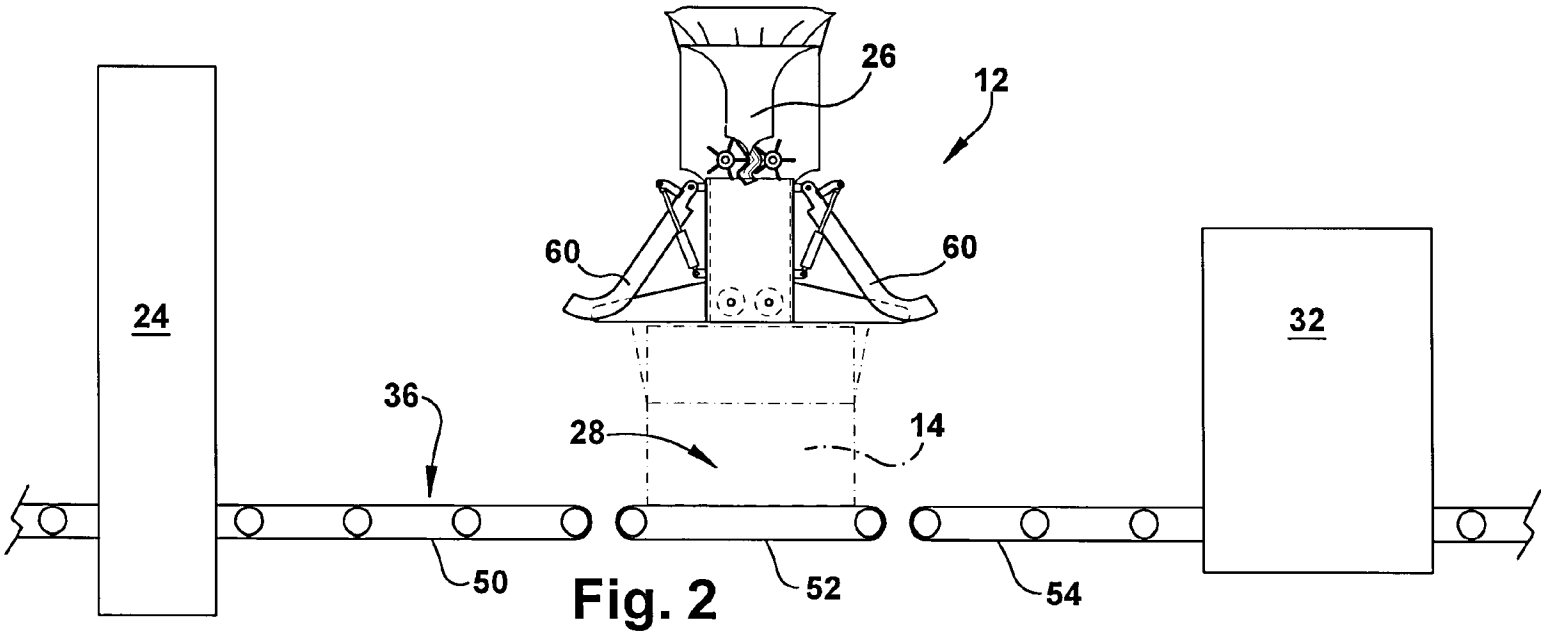
FIG. 2 is an schematic elevational view of a portion of a packing of FIG. 1, showing an exemplary embodiment of an automatic dunnage filling system according to the invention.

As shown in FIG. 2, the conveyor 36 can have multiple segments 50, 52 and 54 for transporting a container 14 through the packing system 10. Each segment of the conveyor is independently controllable by the controller 30 (FIG. 1) to regulate the flow of containers 14 through the packing system 10. The first conveyor segment 50 transports a container 14 past the void measuring device 24 (and passes the container to the second conveyor segment 52.

Figure 3:
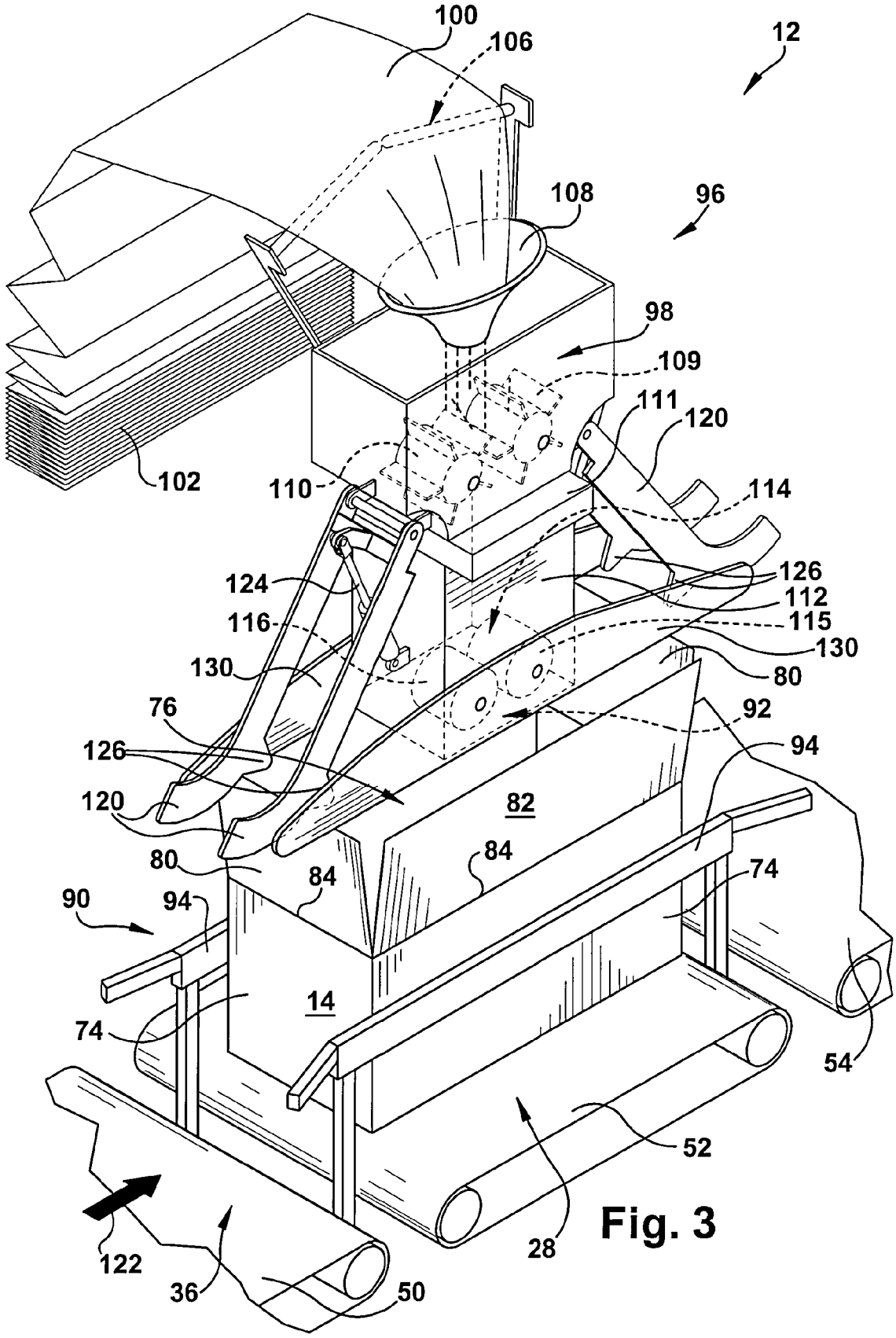
FIG. 3 is an enlarged perspective view of the dunnage dispenser portion of the dunnage filling system of FIG. 2.
Figure 4:
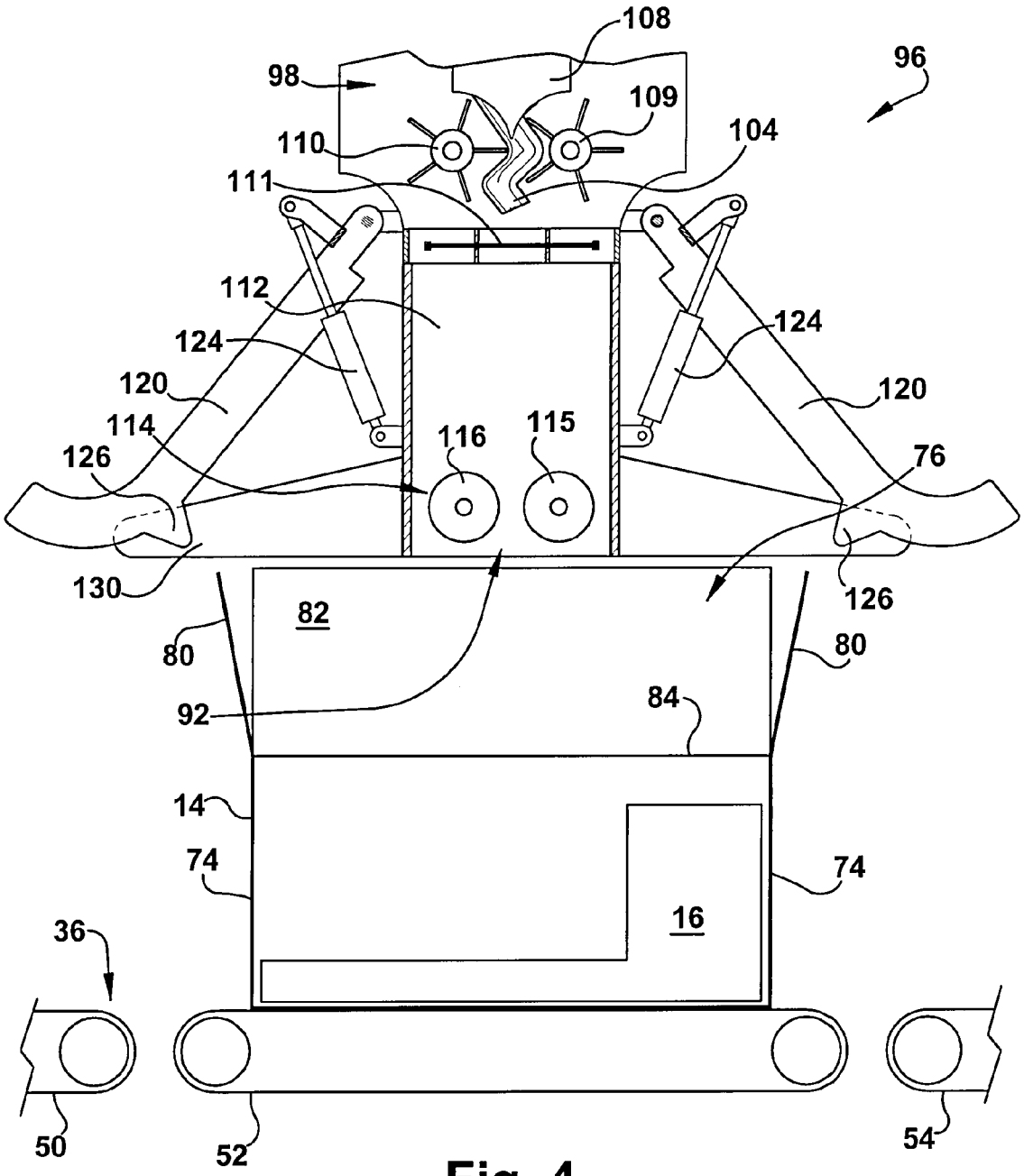
FIGS. 4-9 are sequential schematic cross-sectional elevational views of the dunnage dispenser shown in FIG. 3 that illustrate a dispensing operation.
Figure 5:
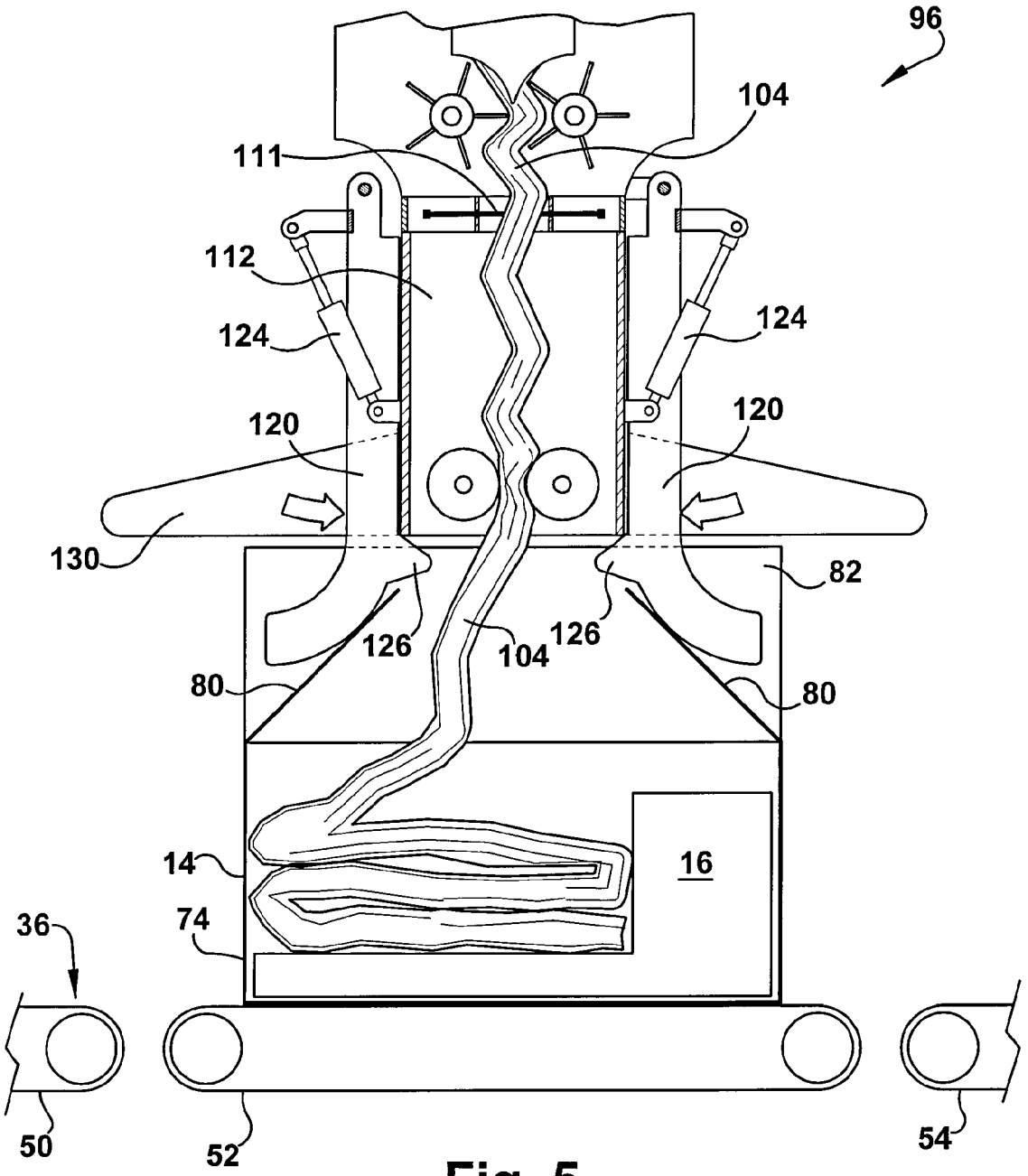
Figure 6:
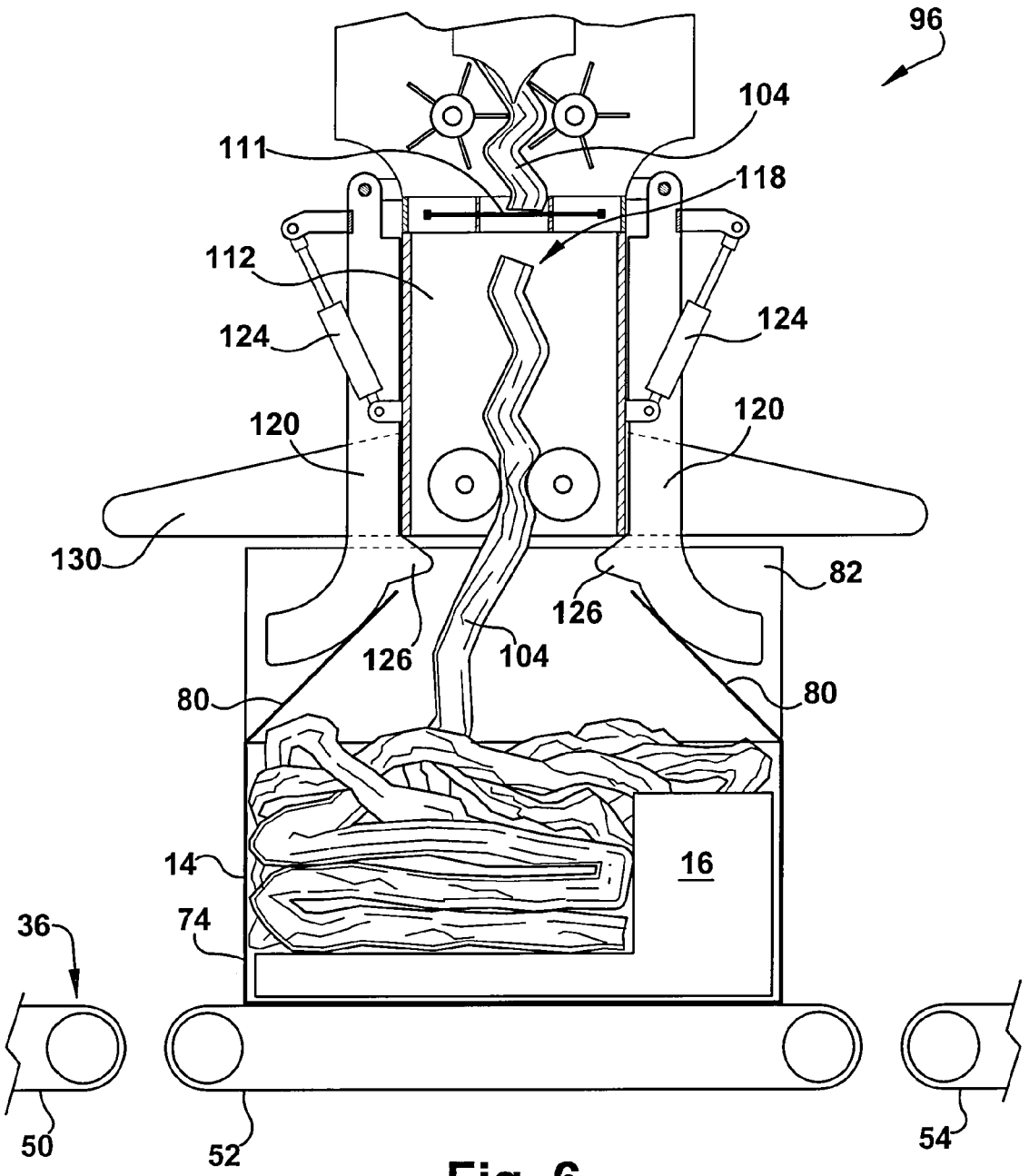
Figure 7:
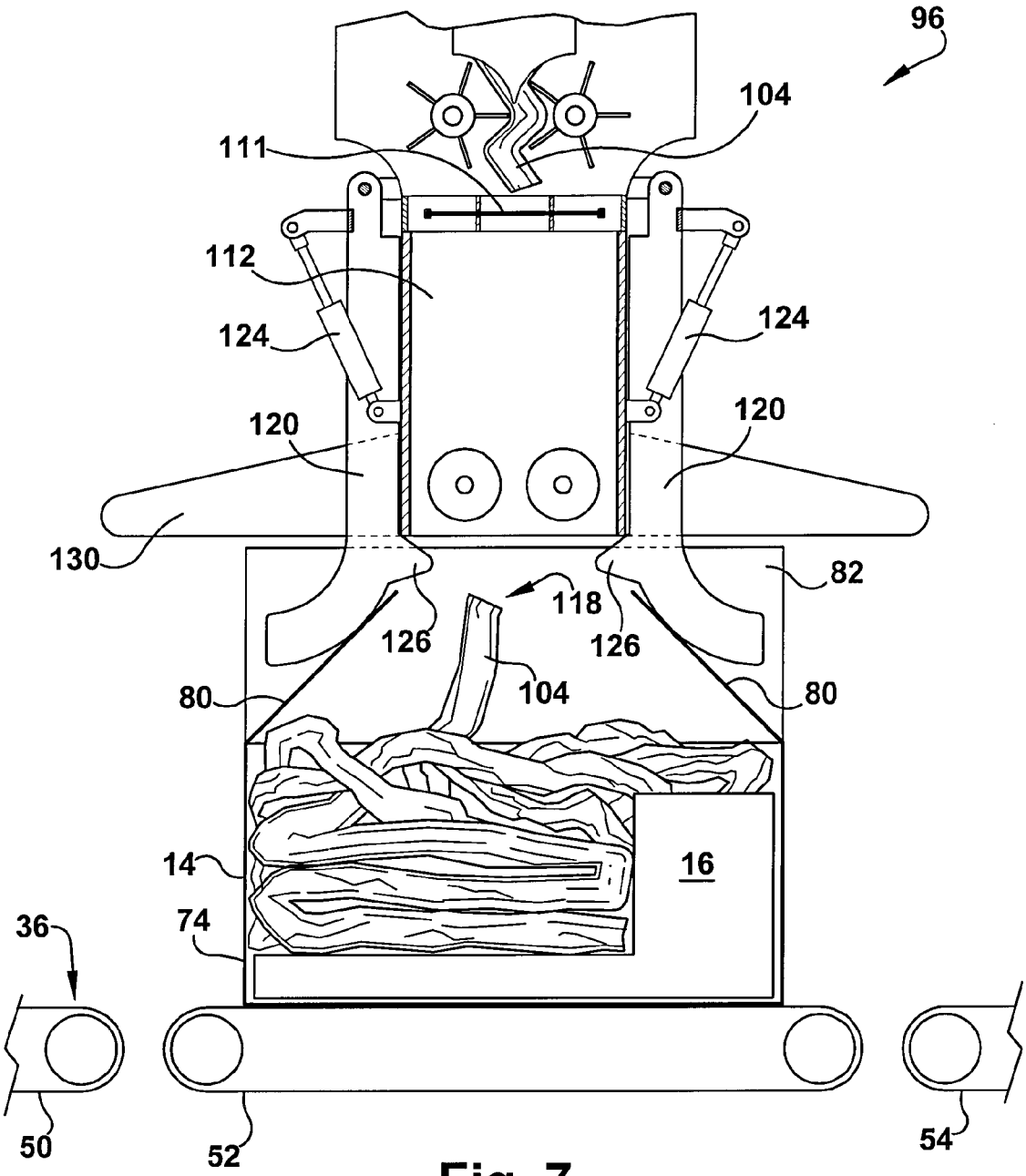

A typical shipping container or box 14 is shown in FIG. 3. As above mentioned the container 14 can take other forms, but the herein shown exemplary embodiment is intended for use with boxes and thus is chiefly described in this context. The container 14 has a closed bottom side, substantially vertical side walls 74 perpendicular to the bottom side and to adjacent side walls, and an open top side 76 bounded by opposing pairs of flaps 80 and 82 extending upward from top edges of the side walls. The flaps 80 and 82 are foldable along a horizontal fold line 84 at the top edge of the side walls 74 to close the open side 76 of the container 14. In place of or in addition to such a container, a shoebox-style container that does not have flaps can be used in some situations (such as the container shown in FIG. 18). This type of container is closed by a lid placed over the open side of the container.

The conveyor 36, and particularly the second conveyor segment 52, transports the container 14 to the dunnage filling or dispensing station 28 where a positioning assembly 90 positions the container 14 relative to an outlet 92 of a dunnage dispenser 12. The positioning assembly 90 includes one or more movable members 94 that engage the container 14 to guide and move the container 14 relative to the conveyor segment 52, and thereby align the open side of the container 14 with the outlet 92. The illustrated pair of movable members 94 engage opposing side walls 74 of the container 14 and laterally center the container on the conveyor segment 52. The flaps 80 and 82 of a container 14 are upright if not vertical. As oriented by the positioning assembly, two of the flaps 82 generally extend parallel to the direction of motion 122 imparted by the conveyor 36 to the container 14, and the other two flaps 80 extend perpendicular to the conveyor direction 122. The positioning assembly 70 thus positions the container 14 in a filling zone at the dunnage filling station 28, ready for receipt of dunnage from the outlet 92 of the dispenser 60. The second conveyor segment 52 can be stopped or the positioning assembly can hold the container 14 in place against movement of the conveyor segment 52, whereby the container 14 can be filled with dunnage while stationary. Alternatively, the conveyor segment 52 can be controllably moved while dunnage is being dispensed into the container 14. After dunnage is fed into the container 14, the second conveyor segment 52 passes the container 14 to the third conveyor segment 54 which transports the container 14 past the container sealer 32 where the process of closing the container 14 for shipment is completed.

The dunnage filling system 12 includes a dunnage dispenser 26 for dispensing dunnage into the box 14 at the dunnage filling station 28. The dunnage filling system 12 shown in FIGS. 3-9 includes an exemplary dunnage dispenser 96 for dispensing dunnage from a source thereof. Any dunnage dispenser that dispenses a strip of dunnage, such as a paper strip, a string of air bags or foam beads, extruded foam, etc., can be provided in accordance with the present invention. The illustrated dunnage dispenser 96 includes a dunnage converter 98 that draws a stock material 100 from a supply 102, in this case a stack of fan-folded sheet stock material, and converts it to a strip of dunnage 104 that is relatively less dense than its original stock material 100. Although the dunnage dispenser is described herein as one or more components that automatically deliver dunnage to a container, the source of dunnage, such as a dunnage converter, can be considered to be a "dunnage dispenser" by itself, from which other components described herein guide and feed the dunnage from the dunnage converter to the container.

An exemplary dunnage converter is disclosed in U.S. Pat. No. 6,676,589, the entire disclosure of which is hereby incorporated by reference. An exemplary sheet stock material for use in such a converter includes at least one ply of kraft paper, which can be provided in a fan-folded stack as shown. Alternatively, a sheet stock material can be provided in roll form. The dunnage converter 98 includes a constant entry member 106 over which the sheet stock material is drawn into a funnel or converging chute 108 that inwardly gathers and randomly crumples the stock material as it is drawn therethrough to form the strip of dunnage.

The dunnage converter 98 also includes a pair of rotating feed members 109, 110 that pull the sheet stock material 100 through the funnel 108 and then feed the crumpled strip from the funnel 108 into a dispensing chute 112 that terminates at the outlet 92 of the dunnage dispenser 96. The dunnage converter 98 also includes a separating mechanism 111 for separating a length of the dunnage strip at a separating location upstream of the dispenser outlet 92 and upstream of a device that is operative to feed a trailing portion or end of the separated length of dunnage strip out of the dispenser outlet. The separating mechanism 111 can include a controllably movable cutting blade for separating a length of dunnage. In general, the rotating feed members 109 stop, then a movable cutting blade crosses the path of the strip of dunnage 104. The trailing end 118 of the separated strip of dunnage 104 is then free from its connection to the remaining stock material in the dunnage converter 98.

Adjacent the outlet 92, the dunnage dispenser 96 includes a pusher 114 for pushing the trailing end 118 of the dunnage strip 104 lengthwise out the outlet 92 and preferably propelling it toward the container support and into a capture zone within the confines of the open container 14, whereby upon closing the container 14 the dunnage strip, and particularly the trailing end of the strip, will be captured therein. The illustrated pusher 114 includes a pair of rotating members 115, 116 between which the strip of dunnage 104 is propelled. The rotating members 115 and 116 preferably are resilient members, such as brushes, paddle wheels or rollers that have resilient bristles, paddle wheels or covers that resiliently frictionally engage and feed the dunnage strip, preferably without damaging its cushioning or void-filling properties. If the pusher 114 only engages the trailing end of the dunnage strip, however, some loss of cushioning or void-filling properties may be acceptable. Other kinds of pushers can be used in place of or in addition to the illustrated rotating members. For example, an air blast or jet can be used to assist the dunnage in moving into the container 14. An exemplary rotating member is a rotatable, generally cylindrical brush, which allows the rotating member to engage and slip against the strip of dunnage 104 without damaging it. The rotating brushes 115 and 116 can be rotated at an effective tangential speed that is greater than the speed at which the rotating feed members 109 and 110, whereby the brushes can slip relative to the strip of dunnage 104 but will move the trailing end of the strip through the outlet 92 and propel it into the confines of the container 14.

In addition to the dunnage dispenser 96, the dunnage filling system 12 also may have associated therewith a container closer with at least one closer member to close or hold closed a cover or one or more flaps of a container. In this embodiment, the dunnage filling system 12 includes a flap-closing assembly at the dunnage filling station 28, with at least one first movable member for at least partially closing at least one flap of a container 14 at the dunnage filling station 28. The illustrated flap-closing assembly includes a pair of flap pushers 120 on opposing sides of the container 14 that are mounted for rotation about an axis at an upper end thereof. The position of the illustrated flap pushers 120 is controlled by respective pneumatic actuators 124. Other means for moving the flap pushers 120 against the flaps 80 of the container 14, such as hydraulics, electric motors, solenoid, etc. can be used in place of or in addition to the pneumatic actuators 124 to move the flap pushers 120. Moreover, other means may be employed to move the flaps, in addition to or in place of the illustrated movable members. For example, air jets could be used to push the flaps inwardly to a closed position, or to an inclined position against a side of the guide chute 112.

The flap-closing assembly uses one or more flap pushers 120 to push one or more flaps inwardly from an upright ready position (FIG. 4) to an inclined dispensing position (FIG. 5) extending over the open side 76 of the container 14 to partially close the open side of the container 14. The illustrated embodiment includes a pair of flap pushers 120 on opposing sides of the outlet, but in some instances only one flap pusher 120 may be actuated. The flap pushers 120 preferably push the flaps to an angle of at least about forty-five degrees relative to vertical to facilitate further closing the flaps by pushing downward on them. The flap pushers 120 have an outer surface facing inward relative to the outlet 92 for engaging respective flaps 80, specifically the flaps that extend perpendicular to the conveyor direction 122. The flap-engaging surface of the flap pushers 120 has an approximate J-shape. Protruding from the J-shape surface of the flap pushers 120 is a heel or spur 126 that facilitates pushing the flaps 80 inwardly over a range of container sizes, and in particular facilitates engaging the flaps of smaller container sizes than a spur-less J-shape surface. Thus the flap pushers 120 recruit the flaps 120 to form a continuation of the guide chute 112 whereby the flaps 80 assist in guiding and containing the strip of dunnage within a capture zone of the flaps as the strip is fed into the container 14. Alternatively, the flaps can be left upright until after the trailing end of the dunnage strip 104 has been fed from the outlet 92 of the dunnage dispenser 96. After the dunnage 104 has been fed into the container 14, the flap-closing assembly returns the flap pushers 120 to the ready position of FIG. 4.

Figure 8:
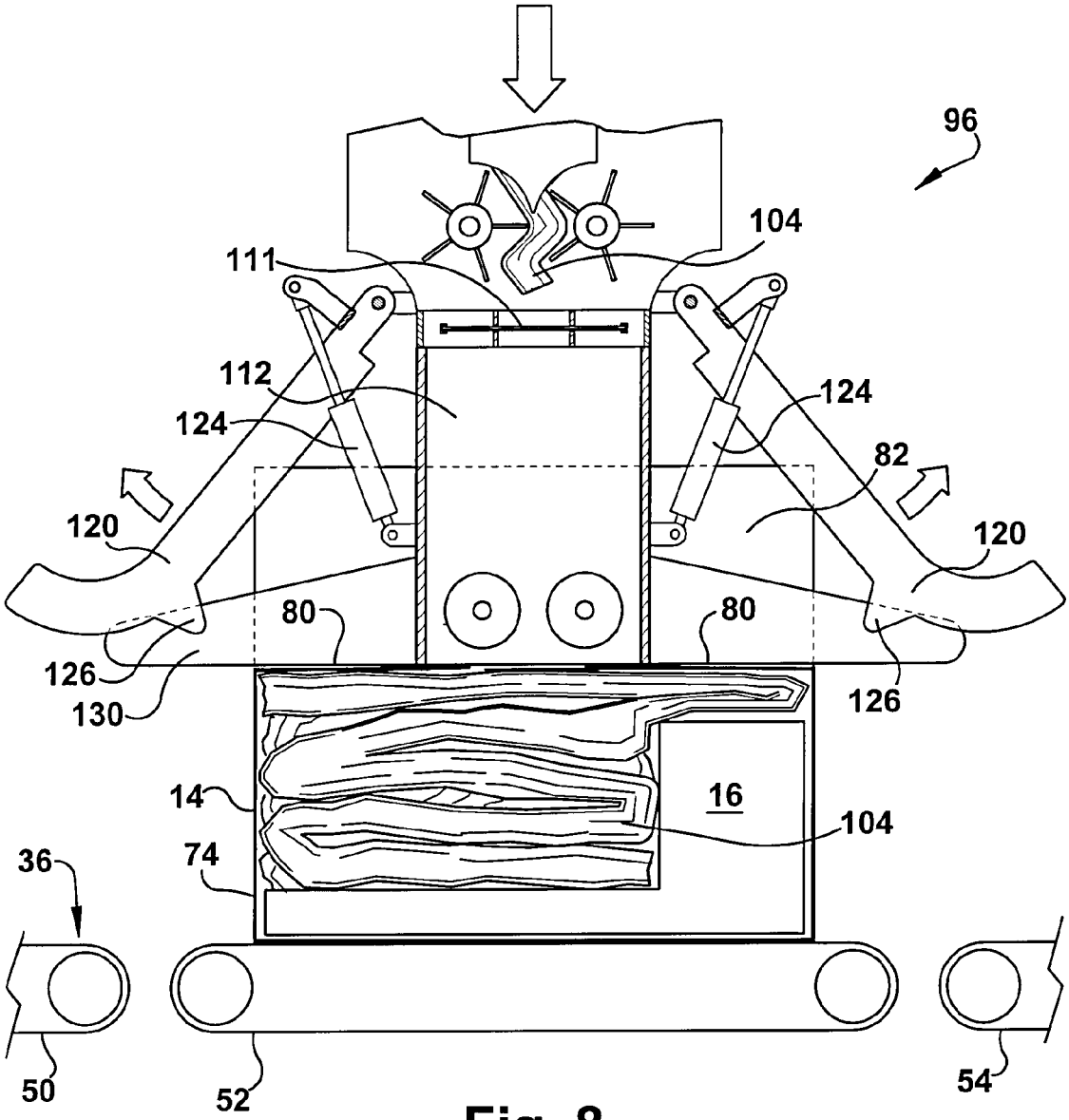
Figure 9:
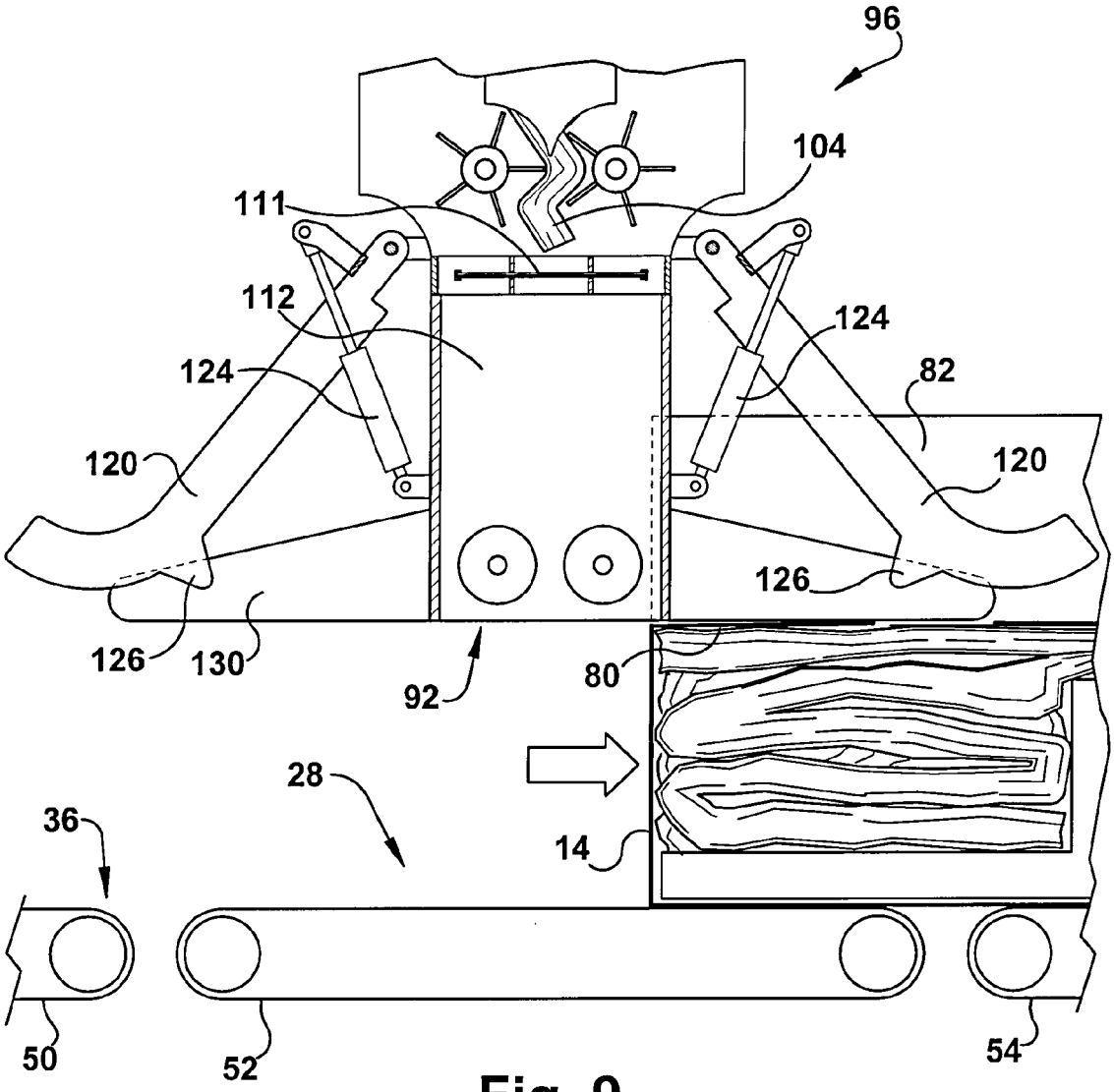

To facilitate closing the container 14 further and to ensure that the trailing end of the strip 104 of dunnage is captured within the container 14, the flap-closing assembly also includes a second movable member with a generally horizontal surface that is movable relative to the conveyor 36 or other container support to move the flaps from the inclined partially-closed position (FIG. 7) to a substantially horizontal closed position (FIG. 8). In the illustrated embodiment, this horizontal surface is defined at least in part by a pair of generally horizontal rails 130, the lower surfaces of which are mounted to extend beyond the outlet 92 of the dispenser 96. The rails 130 extend parallel to the direction the container 14 moves on the conveyor 36 beyond the maximum expected container size to minimize the possibility of a distal end of a rail 130 catching on an inside portion of the container 14. The rails 130 have a bottom surface that is generally parallel to the surface of the conveyor 36. The bottom surface of the rails can be extended by plate members therebetween, provided that a path is provided for the flap-pushers 120 to engage the container flaps 80.

The rails 130 preferably engage the distal ends of the inclined flaps 80 when the flap pushers 120 retract to prevent the flaps 80 from returning to their upright position. The rails 130 preferably hold at least one flap closed as the container 14 is moved from the dunnage filling station 28. Although the flap-closing assembly only moves the flaps 80 to a closed position, and those flaps might not completely close the open side of the container 14, the flap-closing assembly does partially close the container by moving at least one flap to its closed position. The confines of the container include a space bounded by the extent of the flaps 80 and 82 and the side walls 74 of the container 14. The flaps 80 further define a capture zone between their upright open position and their substantially horizontal closed position, whereby in moving the flaps 80 to the closed position the flaps 80 will engage and hold any dunnage in the capture zone within the container.

In the illustrated embodiment, the rails 130 are mounted to the dispensing chute 112 with the bottom surface thereof at or below the outlet 92. Thus, to move the rails 130 and thus close the flaps, the dunnage converter 98 and the dispensing chute 112 are mounted for controlled vertical movement toward and away from the conveyor 36 and the containers 14 moving thereon. For filling a container 14, the outlet 92 of the dispenser 96 typically is positioned near a top of the upright flaps 80 and 82 of the container 14. Upon pushing the flaps 80 toward a horizontal orientation, the outlet 92 generally is near the fold line 84 at the top of the side walls 74 of the container 14. Both of these positions of the outlet 92 can vary with the size of the container 14. The dunnage filling system can be programmed to position the outlet 92 of the dispenser 96 at different heights relative to both the container support and the container, both for dispensing dunnage and for closing the flaps 80, to accommodate different size containers 14. The conveyor 36 then moves the container 14 out of the filling zone and the dunnage filling station 28 while holding the flaps 80 down (FIG. 9), and hands off the container to the box sealer. The resilient nature of most dunnage may tend to push the flaps back open. Preferably, the rails 130 or another device including a component of the box sealer 32 (FIG. 1) holds the flaps in their closed position all the way to the box sealer 32 (FIG. 1) so that the flaps 80 do not have an opportunity to open back up and allow the dunnage to escape therefrom. Once the container has passed out of the dunnage filling station 28, the rails 130 are raised to the extended flap height of the next container, under the direction of the controller 30 (FIG. 1) based on one or more signals from the void mechanism 24 (FIG. 1).

Figure 10:
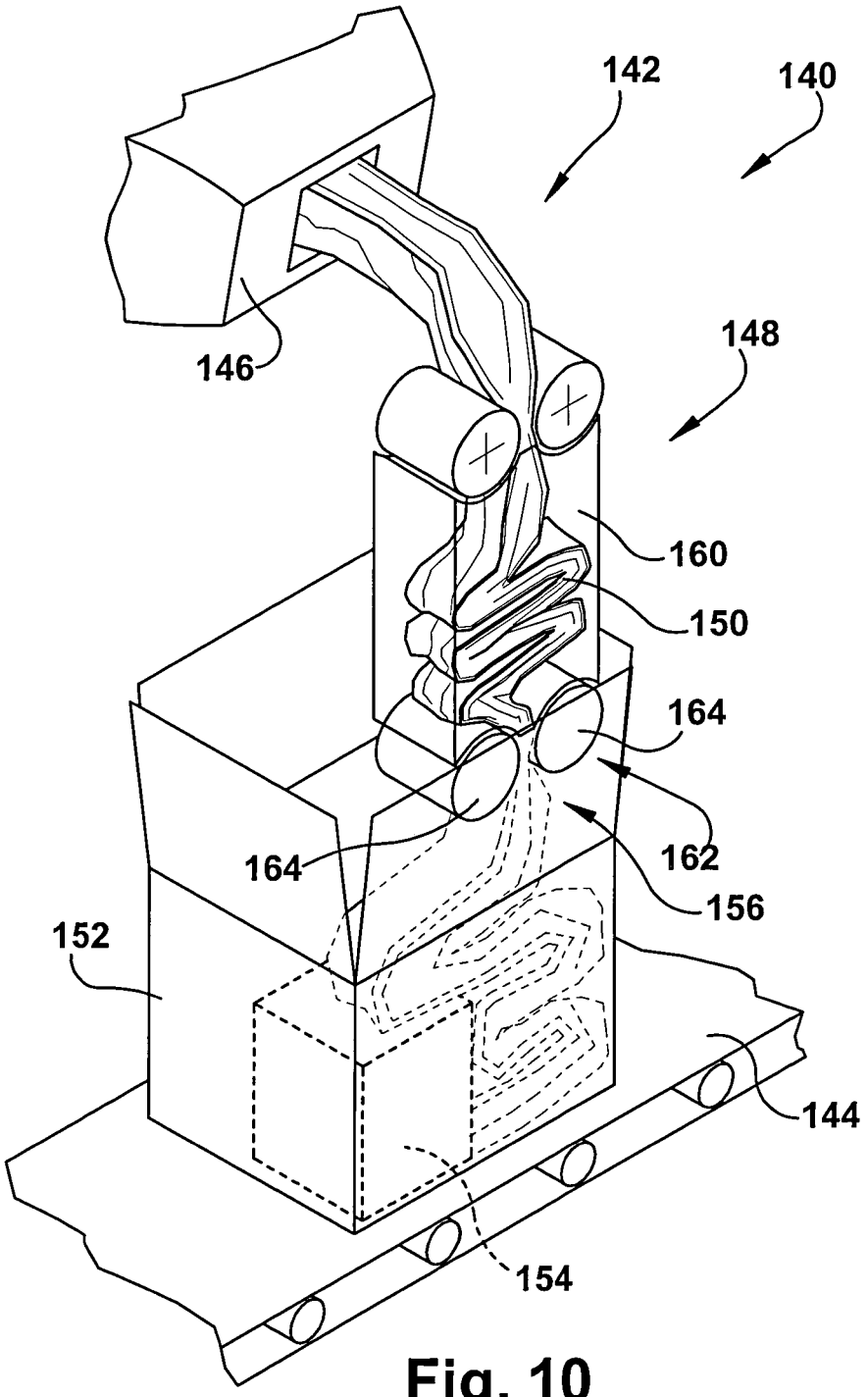
FIG. 10 is a schematic perspective view of another dunnage filling system according to the present invention, which includes elements for relatively positioning and supporting the container with respect to a dunnage dispenser.

Another embodiment of an automatic dunnage filling system 140 according to the present invention is shown schematically in FIG. 10. As in the previous embodiment, the dunnage filling system 140 includes a dunnage dispenser 142 and a container support in the form of a conveyor 144, and the dunnage dispenser 142 includes a dunnage conversion machine or converter 146, for dispensing a strip of dunnage 150 into a container 152 in which an object 154 has been placed for shipping.

The dunnage dispenser 142 also includes a dispensing assembly 148 that receives the strip of dunnage 150 from the converter 146, and then guides and feeds the dunnage strip through an outlet 156 of the dispenser 142 and into a container 152. In FIG. 10, the dispensing assembly 148 includes an elongated accumulating chamber or guide chute 160. An outlet feed device or pusher 162 at a downstream end of the accumulating chamber 160 inhibits yet allows passage of the dunnage strip 150 therethrough so that the dunnage strip 150 enters the chamber 160 at an upstream end at a first rate and exits the chamber 160 at a downstream end at a second rate that is less than the first rate. As used herein, the terms "upstream" and "downstream" refer to the flow of stock material and dunnage through the dunnage dispenser from an upstream end toward the outlet at the downstream end. The different feed rates into and out of the accumulating chamber 160 cause the dunnage strip 150 to undulate sideways, or snake, back and forth widthwise and/or depthwise in the chamber 160, which promotes folding of the dunnage strip 150 as it traverses the length of the elongated accumulating chamber 160 through the outlet and into the void in the container 152. As the dunnage strip 150 passes from the accumulating chamber 160, through the outlet 156 and into the container 152, it has a tendency to fold at spaced points along its length. These pre-imparted fold points improve the flow of the dunnage strip 150 and improves its ability to fill the void around the objects 154 in the container 152 as it tends to fold at those points as it is fed into the container 152.

As in the dispensing chute 112 (FIG. 3) in the previous embodiment, the pusher 162 in the illustrated dunnage dispenser 142 includes at least one rotating member 164, and preferably a pair of rotating members 164 cooperative to engage and advance the trailing end of the dunnage strip therebetween, mounted in the chamber 160 adjacent the outlet 156 to engage the dunnage strip 150 and propel it out of the outlet 156. The rotating members 164 are the same as those in the embodiment of FIG. 3, and can slip relative to the strip 150 while it is being fed therebetween, yet will engage and drive the trailing end of the dunnage strip without crushing it, which could damage or destroy its cushioning and/or void-filling properties. In fact, some slippage between the rotating members and the dunnage is acceptable.

In contrast to the dispensing chute 112 (FIG. 3) of the previous embodiment, the dispensing assembly 148 also includes an inlet feed device 166 at the upstream end of the accumulating chamber 160 and disposed along the path of the dunnage strip 150 for engaging and advancing the dunnage strip from the converter 146 and into the elongated accumulating chamber 160. In particular, the illustrated inlet feed device 166 includes a pair of opposed rotating members 168 disposed on opposite sides of the path of the strip at an upstream end of the accumulating chamber 160. The upstream rotating members 168 can be the same as the downstream rotating members 164. The rotating members 168 at the upstream end of the elongated accumulating chamber 160, however, are rotated to provide a feed rate that is higher than that provided by the rotating members 164 at the downstream end of the elongated accumulating chamber 160, which creates the desired undulating movement of the dunnage 150 in the chamber 160 therebetween. The dunnage filling system 140 shown in FIG. 10 is effective at filling a void in a container that is not uniform, such as a void that appears on only one side of the objects in the container, and can effectively fill the void in a range of sizes and volumes.

Figure 11:
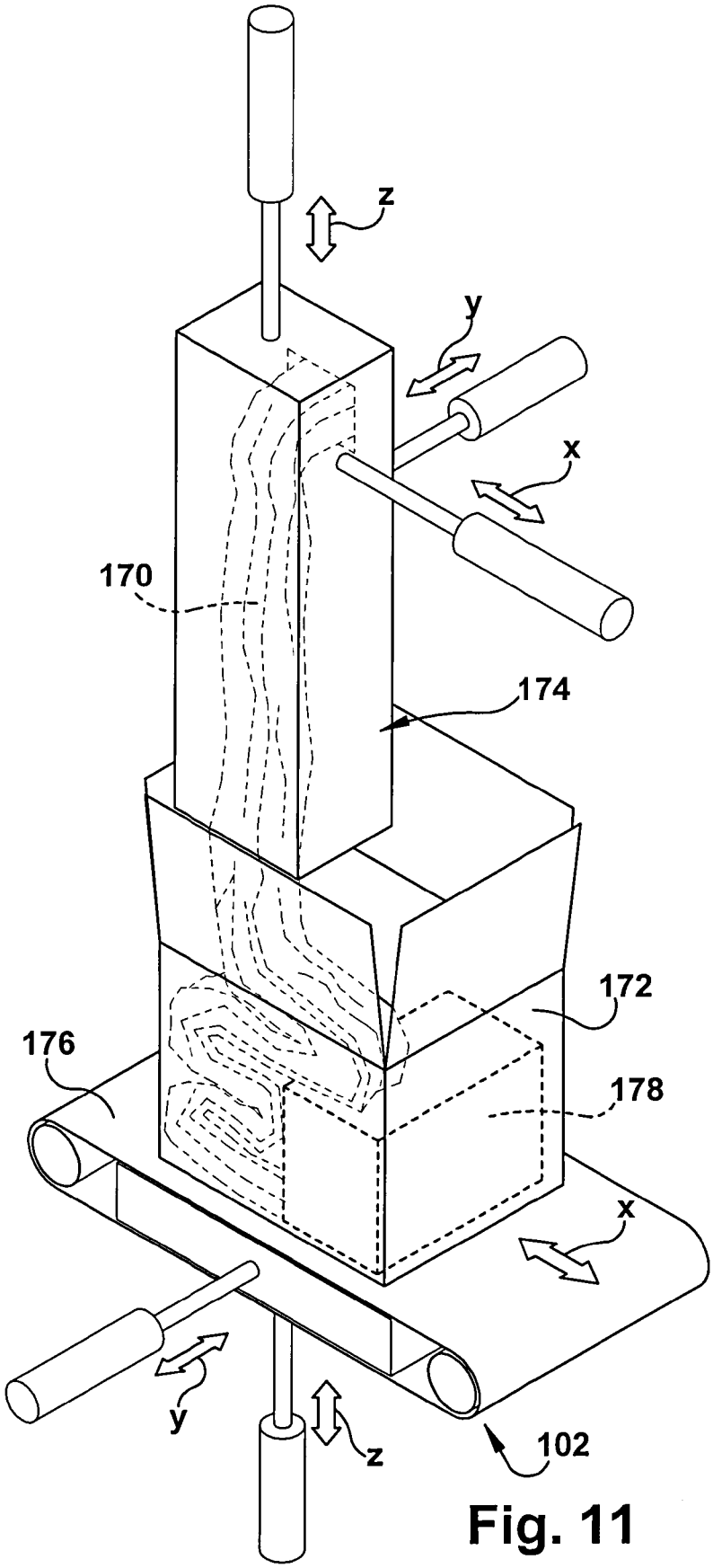
FIG. 11 is a schematic perspective view of another automatic dunnage filling system according to the present invention.

As shown in FIG. 11, to facilitate distributing a strip of dunnage 170 to different parts of a container 172, an outlet of a dunnage dispenser 174 and/or a container support 176 for supporting a container 172 thereon may be movably disposed relative to each other. Accordingly, the dunnage filling system can include a mechanism for positioning the outlet of the dispenser relative to the open side of the container. The outlet preferably is positioned in close proximity to an open side of the container, including at an elevation above or below the upper extent of the upright flaps, or an upper extent of the side walls of the container, for example, during feeding of the dunnage strip from the outlet. As shown in FIG. 11, the dispenser outlet 172 and the container support 176 are controllably moved relative to one another in respective X, Y and Z orthogonal directions to position the outlet to distribute the dunnage to different places in the container 172.

Additionally or alternatively, the dunnage dispenser can include a flexible portion (not shown), for example, to facilitate directing the dunnage to specific voids in a container. As a further alternative, the outlet can be fixed and aligned with a movable curved or inclined guide surface, that is movable to direct dunnage fed from the outlet to the container and/or a desired location within the container. This guide surface can be mounted downstream of the outlet for rotation about an axis that is parallel to the axis of the outlet, and/or the outlet can be pivotally mounted to a gimbal to dispense the dunnage in a desired direction. Although the outlet of the dunnage dispenser and/or the container support can be guided manually or semi-automatically by an operator to fill the void as the dunnage dispenser automatically dispenses dunnage, the relative movement of the outlet and the container support preferably is automatically controlled based on information received from a contour sensor, for example, that determines the contour of the interior of the container and its contents.

In FIG. 11, the container support 176 includes a platform in the form of a conveyor that can move the container 172 back and forth in a longitudinal or X-direction, and the conveyor itself is moveable in both a vertical Z-direction and a sideways Y-direction to receive the dunnage in a void around the objects 178 in the container 172. This movement can be controlled automatically to fill a void having an irregular three-dimensional contour around the objects 178 in the container 172.

Figure 12:
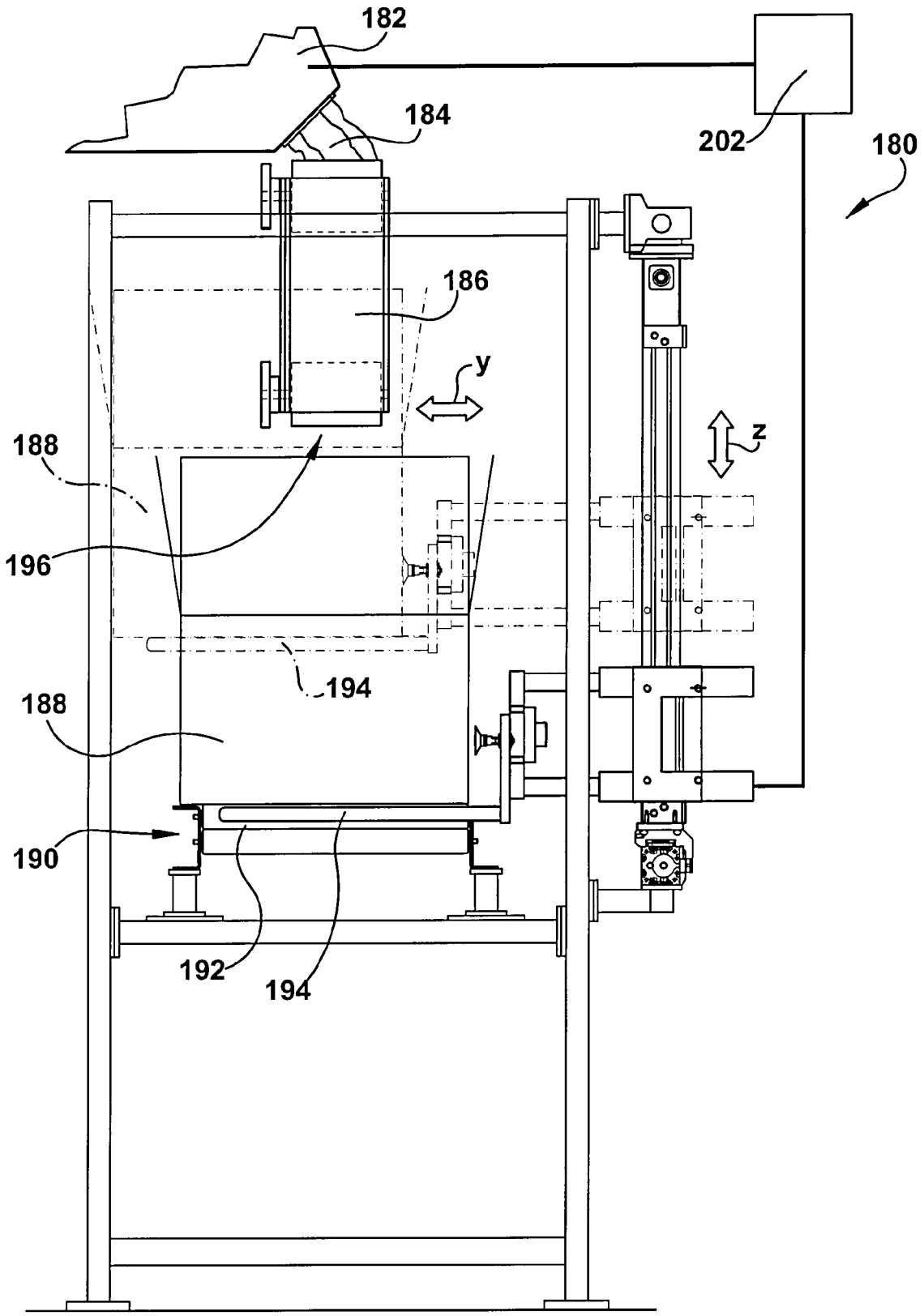
FIG. 12 is a side elevational view of another automatic dunnage filling system according to the present invention.

Alternatively, the container support can include a platform that is separate from the conveyor, as shown in FIG. 12. In this system 180, which is substantially identical to the dunnage filling system 140 of FIG. 10, a converter 182 dispenses a strip of dunnage 184 to an accumulating chamber 186, which in turn feeds the dunnage longitudinally or lengthwise directly into a container 188 that is supported on a positioning device or movable platform 190. The conveyor 192, which can be a roller conveyor, for example, delivers the container 188 to a packing position at the dunnage filling station. The movable platform 190 can include forks that extend between the rollers of a roller conveyor, for example, to lift the container therefrom. Appropriate sensors and stops can be used to stop the container at the dunnage filling station in conjunction with control of the operation of the conveyor by the controller 30 (FIG. 1). The movable platform 190 can raise the container 188 above the conveyor 192 in a vertical Z-direction and can move the container 188 horizontally, including in the Y-direction, as shown in phantom in FIG. 12. The movable platform 190 can be controlled by the controller 30 (FIG. 1) to move the container 188 to a fixed position for dispensing a strip of dunnage thereto or to move the container 188 relative to the outlet of the accumulating chamber 186 while the dunnage strip is fed into the container 188. The controller 202 controls the relative movement of the outlet and the movable platform, and also controls the converter 182 to dispense the desired amount of dunnage.

Figure 13:
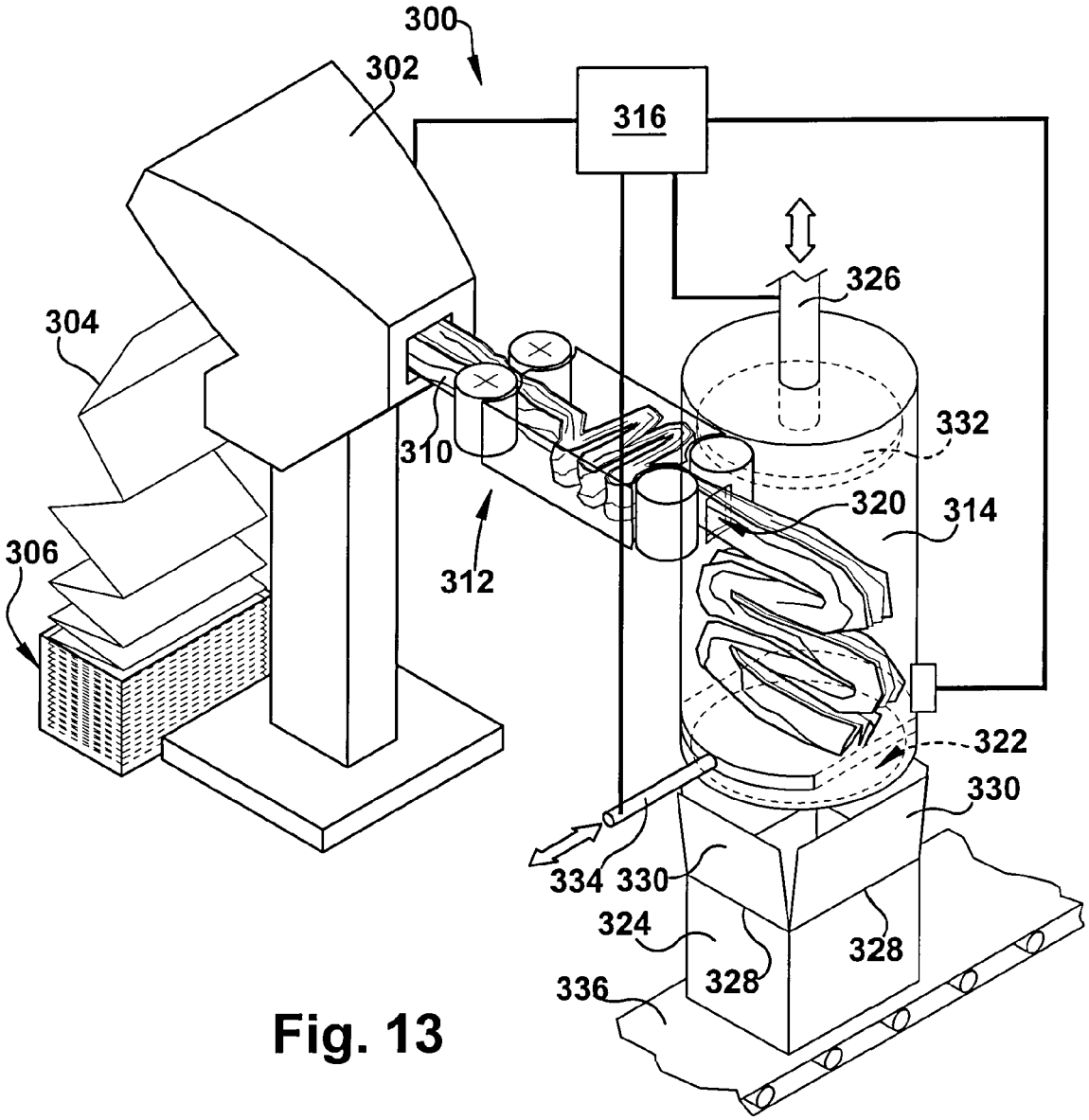
FIG. 13 is a schematic perspective view of another automatic dunnage filling system according to the present invention, that includes a collection chamber.

Another automatic dunnage filling system 300 is shown in FIG. 13, and includes a dunnage dispenser 301 having a dunnage converter 302 that converts a sheet stock material 304 in a fan-folded stack 306 into a strip of dunnage 310, a horizontally oriented elongated accumulating chamber 312 aligned with an outlet of the converter 302, and a collection chamber 314 that receives the dunnage 310 from the accumulating chamber 312 and pushes the dunnage strip out an outlet 322 and into a container 324. The guide chute or accumulating chamber 312 can be aligned with the axis of the collection chamber 314, whereby the dunnage strip 310 can fold or curl on itself within the collection chamber to form a plurality of generally upright segments as shown. The container 324 is supported on a movable container support or positioning device 336, which is typically a conveyor, aligned with the outlet from the collection chamber 314. A controller 316 controls the converter 302 to produce the desired length of dunnage. The elongated accumulating chamber 312 is substantially the same as that described with respect to FIG. 10, but in this embodiment the outlet 322 of the dunnage dispenser 301 is at the downstream end of the collection chamber 314.

The collection chamber 314 has an upstream opening 320 for receiving the strip of dunnage 310 from the accumulating chamber 312 and a downstream opening or outlet 322 for dispensing the dunnage into the container 324. The strip of dunnage 310 received in the collection chamber 314 randomly folds and curls on itself along its length as it collects in the chamber, just as the strip of dunnage does within the confines of the side walls and the flaps of the container in the embodiment of FIG. 3.

A pusher, in this case a plunger 326 having a cross-section that approximates a cross-section of the collection chamber 314, pushes the dunnage from the collection chamber 314, through the outlet 322 and into the container 324. The downstream opening or outlet 322 can be left open such that some of the collected dunnage can pass therethrough before the balance is pushed out. The plunger 326 generally stops near the top of the fold lines 328 for the flaps 330 of the container 324, and can extend into the container 324 somewhat given the resilient nature of most dunnage. In addition, the plunger 326 includes a resilient cushion 332 on its end face made of foam rubber, for example, that contacts the dunnage being pushed from the chamber 314. The cushion 332 helps to promote the filling of all parts of the void around the one or more objects in the container 324 as the dunnage strip 310 is pushed into the container. This dunnage filling system 300 is particularly well-suited for top-filling a container with a substantially uniform-depth void in an upper portion of the container 324, which generally is above the objects placed in the container for packing.

Although not necessary for all situations, the illustrated collection chamber 314 also includes a movable closure member or retainer 334 that is movable between a retention position that blocks the downstream opening 322 of the collection chamber 314 to retain the dunnage 310 therein, and a discharge position that allows the dunnage 310 to pass through the outlet 322 and out of the collection chamber 314. Alternatively, the retainer could include resilient members that hold the dunnage within the chamber but that allow the dunnage to pass when the plunger pushes against the dunnage. The retainer 334 holds the dunnage 310 in the chamber 314 and encourages it to fold therein as the desired amount or length of dunnage 310 is fed into and collected in the collection chamber 314. The retainer 334 also holds the dunnage 310 in the collection chamber 314 while a container 324 is registered relative to the outlet 322. Then the retainer 334 is moved to its open or discharge position and the plunger 326 pushes the entire quantity of dunnage into the container 324 to fill the void therein. Put another way, the chamber 314 is charged with a predetermined quantity of dunnage, and then that dunnage charge is pushed through the outlet and into the void in a container. If the retainer is omitted, the leading end of the dunnage strip 310 can pass through the outlet 322 and into the container 324. Once the desired amount of dunnage 310 has entered the collection chamber 314, the plunger 326 pushes the trailing end of the dunnage 310 into the container 324. In this case, however, the container 324 generally must be in place before the leading end of the dunnage 310 passes through the outlet 322.

Figure 14:
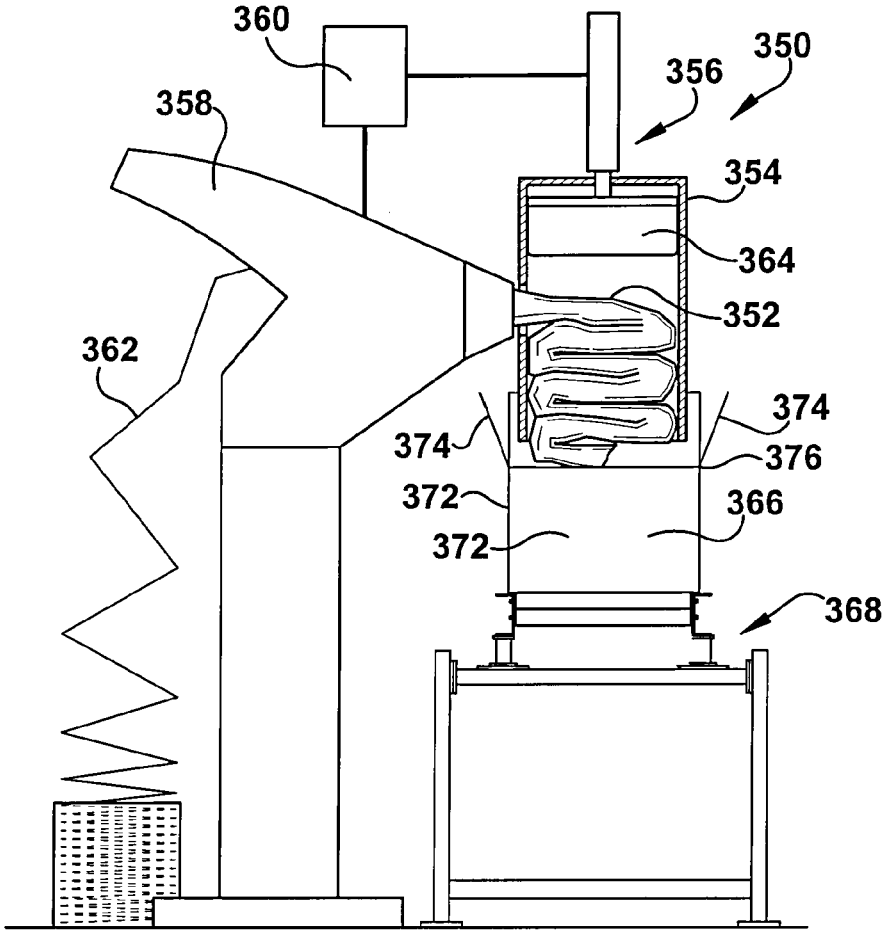
FIG. 14 is a schematic side view in partial cross-section of another automatic dunnage filling system according to the present invention, that also includes a collection chamber.

Another dunnage filling system 350 is shown in FIG. 14. This embodiment is similar to the previously-described embodiment, but omits an accumulating chamber in favor of feeding a strip of dunnage 352 directly into a collection chamber 354. In this dunnage filling system 350, a dunnage dispenser 356 includes a dunnage converter 358 and the collection chamber 354 into which it propels a strip of dunnage 352. A controller 360 controls the dunnage converter 358 to convert a sheet stock material 362 into the dunnage strip 352 and an actuator for a plunger 364 to push a randomly folded strip of dunnage 352 from the collection chamber 354 and into a container 366. The container 366 is supported by a container support 368 that is movable relative to the outlet 370 of the collection chamber 354 to position the outlet 370 proximate a top edge of the side walls 372 of the container 366. In other words, the outlet can be positioned between a distal edge of an upright flap 374 and a flap fold line 376, as an alternative to the position above the vertical extent of the upright flaps 374 shown in other figures.

Various alternative types of collection chambers are shown in FIGS. 15-20 for automatically pushing dunnage into a container. The collection chamber in each case is the same as the collection chamber 354 unless otherwise described.

Moreover, to simplify the description and drawings, the dunnage filling systems shown in FIGS. 15-20 also show a strip of dunnage being fed directly into a collection chamber, as in FIG. 14. Each of these systems could include an accumulating chamber or other guide chute interposed between the dunnage converter and the collection chamber.

Figure 15:
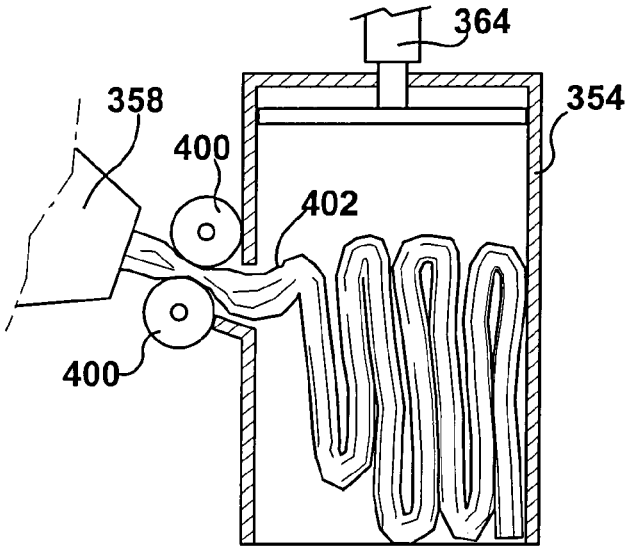
FIGS. 15-19 are schematic cross-sectional views of modified forms of collection chamber assemblies that may be employed in an automated dunnage filling system according to the present invention.

In FIG. 15, a pair of driven horizontal axis rotating members 400 feed a strip of dunnage 402 from the dunnage converter 358 into the collection chamber 354, causing the dunnage strip to form more upright segments as it folds and curls back on itself. These relatively vertical segments of dunnage collect in the collection chamber 354 and the plunger 364 pushes the collected dunnage into a container.

Figure 16:
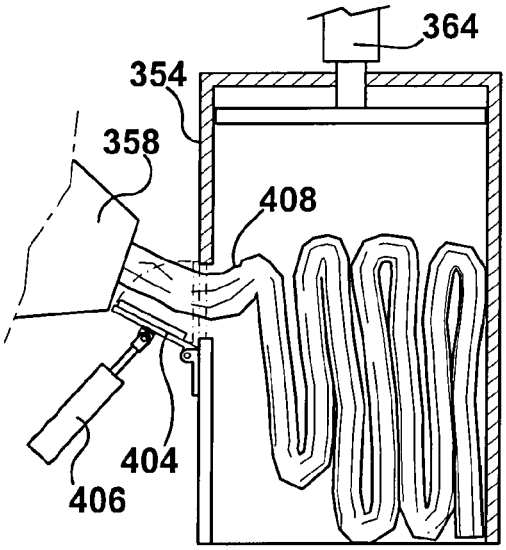

In FIG. 16, the dunnage converter 358 passes a strip of dunnage into the collection chamber 354 through an inlet opening closed by a flipper door 404 hingedly connected to a sidewall of the collection chamber 354 adjacent the inlet. The flipper door 404 is closed by an actuator 406, such as a solenoid, to push the tail end of a strip of dunnage 408 into the collection chamber 354 before actuating the plunger 364.

Figure 17:
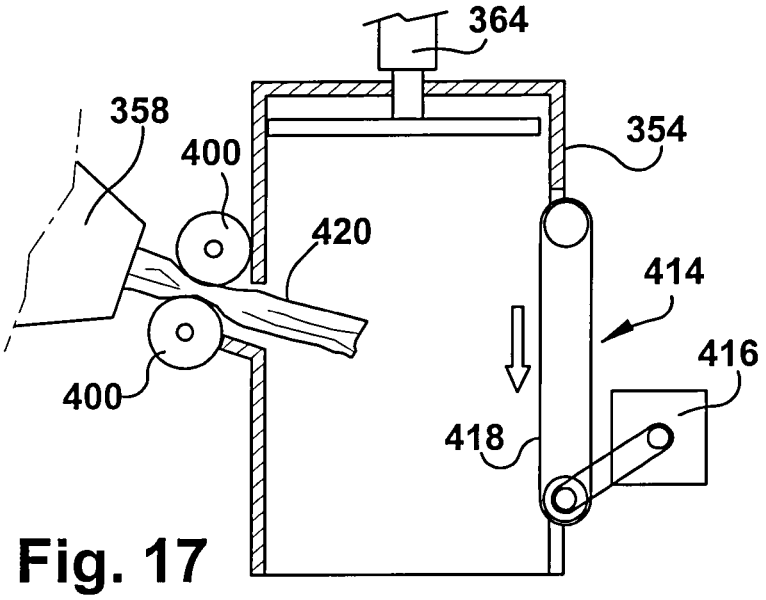

FIG. 17 shows a collection chamber 354 having a conveyor loop 414 mounted to one side of the collection chamber 354 opposite the inlet 415. The conveyor 414 is driven by a motor 416 to present a downstream-moving surface 418 to the dunnage strip 420 as it is fed into the collection chamber 354 by a pair of rotating members 400 from the dunnage converter 358. This is believed to improve the folding action of the dunnage 420 as it engages the moving surface 418 and allows the collection chamber 354 to accommodate a larger range of void sizes.

Figure 18:
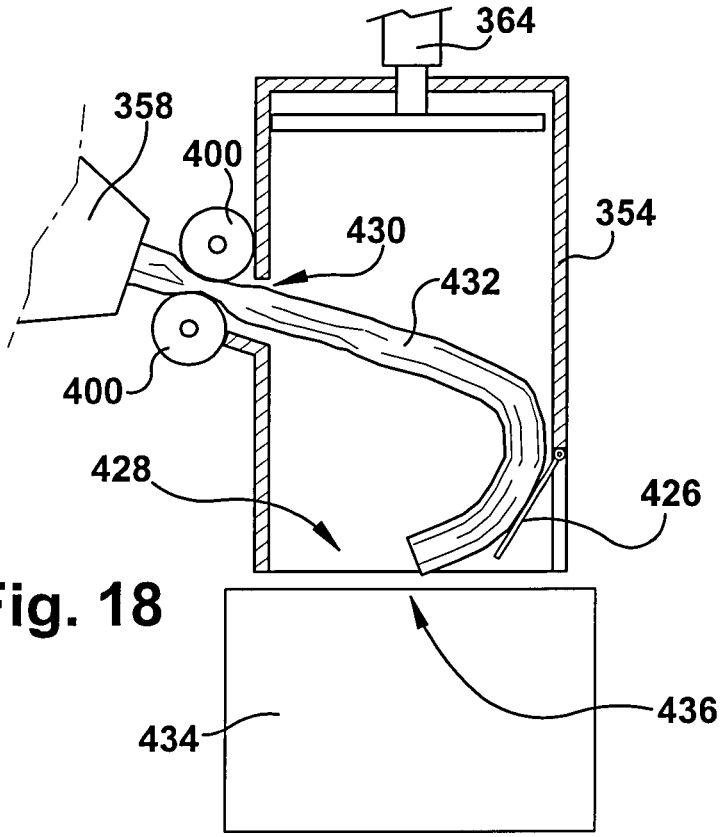

In FIG. 18, a spring-biased door 426 is provided at an edge of the outlet 428 of the collection chamber 354 opposite the inlet 430 to the collection chamber 354. The spring-biased door 426 slopes inwardly and helps to promote folding of the dunnage strip 432 before it enters the container 434. Note that this container is a shoebox-style container without flaps. The container is positioned with its open side 436 adjacent the outlet 428 of the collection chamber 354.

Figure 19:
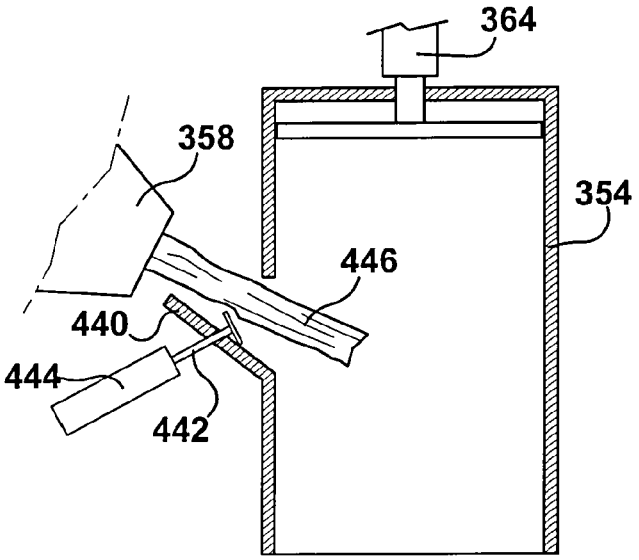

In FIG. 19, the dunnage converter 358 dispenses dunnage onto a ramp 440 and into the collection chamber 354. A pusher bar 442 powered by a solenoid or other drive mechanism 444, in conjunction with the ramp 440, guides the strip of dunnage 446 into the collection chamber 354 and pushes the tail end of the dunnage strip 446 into the collection chamber 354. In place of or in addition to any of the mechanical pushers described herein, an air blast or jet can be used to assist the dunnage in moving into the chamber and/or into a container.

The speed with which the dunnage is fed into the collection chamber, combined with the stiffness and/or other qualities of the dunnage and the dimensions of the space in the collection chamber into which the dunnage is fed, cause the dunnage to undulate back and forth across the width or depth of the collection chamber, curling or folding along its length. As shown in FIGS. 13 and 15, for example, the feed rate of the strip of dunnage as it enters the collection chamber and the dimensions of the collection chamber 354 can effect the behavior of the dunnage strip. Although the drawings are highly schematic, in FIG. 13, for example the dunnage 310 forms generally horizontal loops and folds in the chamber 354 whereby the dunnage pushed out of the collection chamber will generally fill the edges of the container better. As shown in FIG. 15, the dunnage can be made to undulate and fold back on itself more vertically in the chamber, resulting in a void fill dunnage that stands up in the container but might not fill the sides of the container as well.

Figure 20:
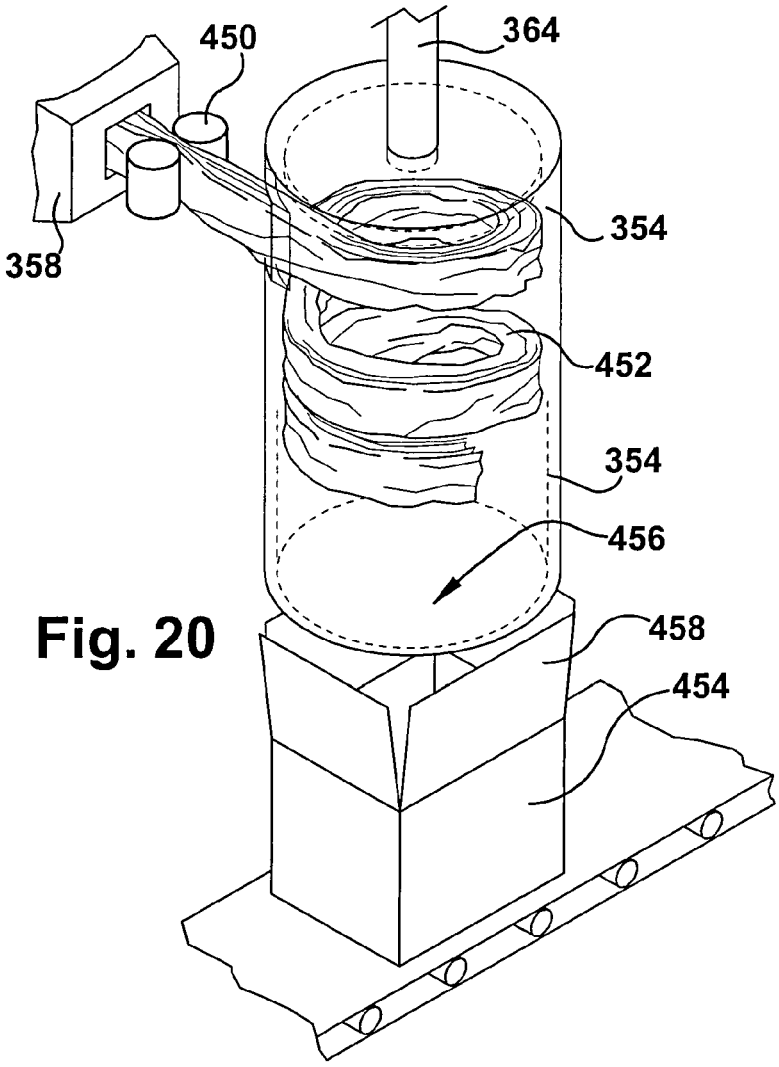
FIG. 20 is a schematic perspective view of a another collection chamber assembly according to the present invention.

In yet another collection chamber 354 shown in FIG. 20, relatively vertical axis rotating members 450 feed a strip of dunnage 452 from the dunnage converter 358 along a longitudinal direction or axis that is offset from a line or axis extending through the center of the collection chamber 354. The collection chamber 354 is cylindrical and has a cylindrical passage therein for receiving the dunnage strip 452. The strip of dunnage 452 is fed into the cylindrical collection chamber along an axis that is generally tangential to an inner curved surface of the collection chamber 354. This encourages the dunnage strip 452 to spiral or coil more horizontally rather than vertically, as was the case in FIG. 15, for example. Since the collection chamber 354 does not include the movable retainer 334 of FIG. 13, the dunnage 452 can go directly from the collection chamber 354 into a container 454 without waiting for the plunger 364 to push the dunnage into the container 454. In this embodiment, note that the outlet 456 of the collection chamber 354 is spaced above the upright flaps 458 of the container 454. As long as the outlet 456 is in proximity to the open side of the container 454 or the extent of the flaps, the dunnage strip will not escape therebetween. Different distances between the outlet and the void, combined with different properties in the dunnage strip, effect different characteristics in the dunnage strip as it is dispensed. Despite what is shown for purposes of illustration in the figures, the dunnage strip generally folds and curls back on itself in a random and not always precisely reproducible manner.

Figure 21:
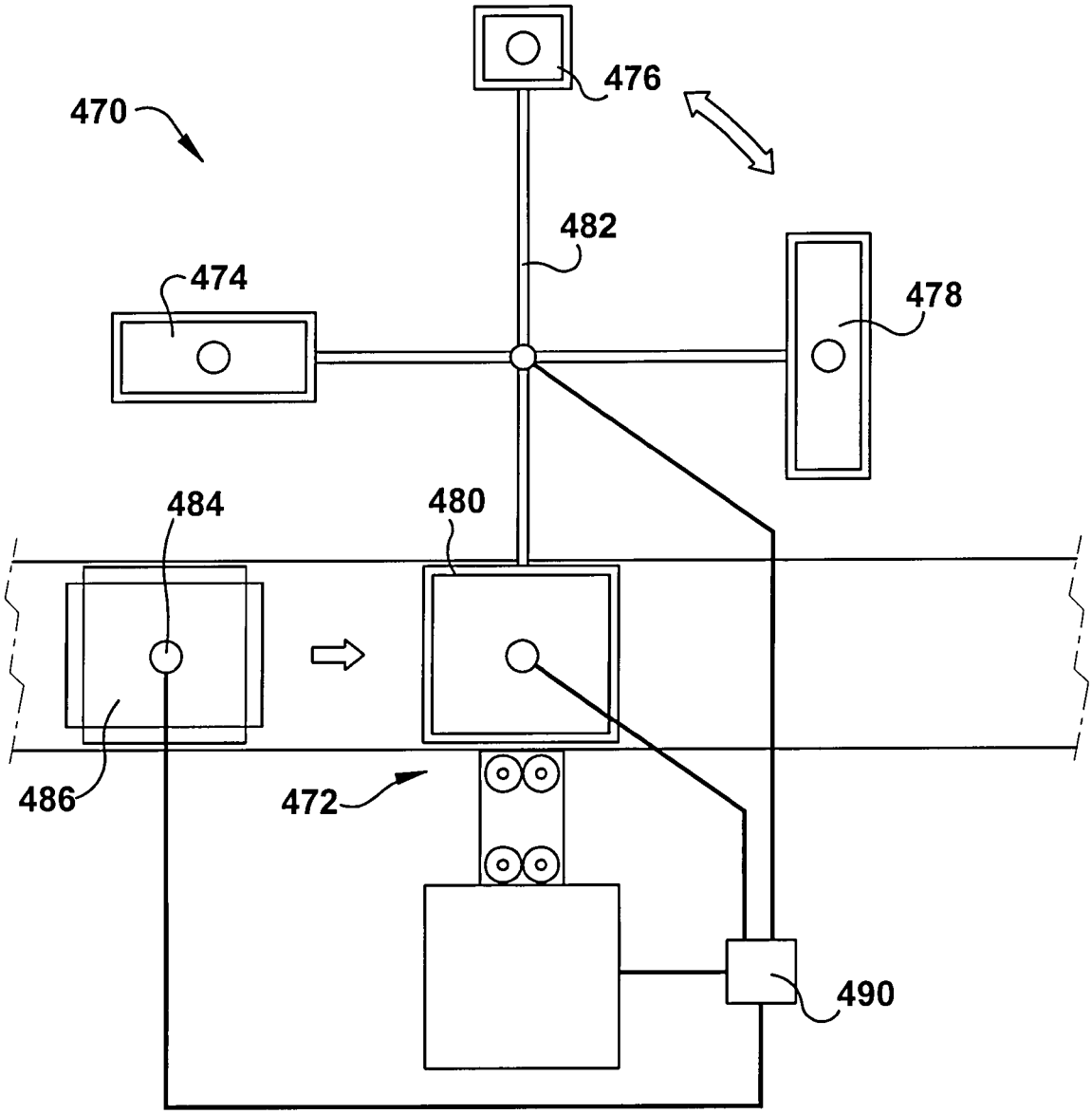
FIG. 21 is a schematic plan view of yet another automated dunnage filling system according to the present invention, that includes a plurality of collection chambers mounted on a carrousel.

As shown in FIG. 21, still another dunnage filling system 470 includes a dunnage dispenser similar to that shown in FIG. 13, with a plurality of interchangeable collection chambers 474, 476, 478 and 480. The collection chamber designed for a particular dunnage filling system generally has a cross-sectional area that approximates the area of the opening in the container. The cross-sectional shape of the collection chamber, however, does not have to be the same as the shape of the opening in the container. The collection chamber can have a cylindrical shape, for example, while most containers have a rectangular shape. This dunnage filling system 470 provides a way to improve the ability to automatically fill a wider variety of container sizes and shapes. Larger and smaller void volumes within containers having the same cross-sectional size and shape can be filled with an appropriate amount of dunnage by adjusting the length of the dunnage strip that is dispensed to respective void volumes.

Each collection chamber 474, 476, 478 and 480 has a different cross-sectional size or shape for use with a particular container and/or volume of dunnage to be dispensed. The plurality of collection chambers 474, 476, 478 and 480 are arranged on a carrousel 482 that positions a selected chamber for use. This dunnage filling system 470 also includes a void sensing device 484 for sensing a void volume in a container 486, and a controller 490 in communication with the void sensing device 484 and the dispenser 472 to control the amount of dunnage to be dispensed into the container. The controller 490 can also selectively control the carrousel 482 to position a selected collection chamber for use based on information from the void sensing device 484.

Thus the dunnage filling system provided by the present invention provides a number of ways to automatically dispense a strip of dunnage into a container to fill a void around one or more objects in the container, thereby minimizing or eliminating the efforts of a packer to guide or place the dunnage, as well as the requirement to have a packer to ensure that the voids are in fact filled. The packer is thereby freed to perform other tasks.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A system for automatically dispensing dunnage into a container having at least one flap inwardly foldable to close an open side of the container, comprising a dispenser having an outlet from which dunnage can be supplied and a container closer adjacent the outlet, the container closer having a first movable member for moving a flap of a container from an upright orientation to an inwardly-inclined orientation extending over an open side of the container, thereby effecting at least partial enclosure of an open side of a container for guiding dunnage into the container during dunnage dispensing.

2. A system according to claim 1, wherein the container closer includes a pair of opposing first movable members having portions that are movable toward each other to move opposing flaps of a container from an upright orientation to an inwardly-inclined orientation over an open side of the container.

3. A system according to claim 1, wherein the container closer includes a substantially horizontal second movable member that is movable to move the flaps from the inwardly-inclined orientation to a substantially horizontal closed orientation.

4. A system according to claim 1, wherein the first member of the container closer has a flap-engaging surface with a generally J-shape that facilitates engaging the flaps of containers for engaging a flap and riding against the flap as it is moved from an upright position to an inclined position.

5. A system according to claim 1, including a container support for supporting the container at a dunnage filling station adjacent the outlet with the open side of the container aligned with the outlet, a container closing station at a location removed from the dunnage filling station for closing and securing the container in a closed condition, and a controller for instructing the dispenser to dispense a strip of dunnage through the outlet and then instructing the container support to transport the container from the dunnage filling station to the container closing station.

* * * * *